US011208754B2

(12) United States Patent
Jung et al.

(10) Patent No.: US 11,208,754 B2
(45) Date of Patent: Dec. 28, 2021

(54) LAUNDRY TREATMENT APPARATUS

(71) Applicant: LG ELECTRONICS INC., Seoul (KR)

(72) Inventors: Sungwoon Jung, Seoul (KR); Hunjun Jang, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 16/829,499

(22) Filed: Mar. 25, 2020

(65) Prior Publication Data

US 2020/0224355 A1 Jul. 16, 2020

Related U.S. Application Data

(63) Continuation of application No. 15/608,575, filed on May 30, 2017, now Pat. No. 10,648,119.

(30) Foreign Application Priority Data

May 30, 2016 (KR) ..... 10-2016-0066815

(51) Int. Cl.
*D06F 39/02* (2006.01)
*D06F 37/26* (2006.01)
(Continued)

(52) U.S. Cl.
CPC ..... *D06F 39/022* (2013.01); *D06F 37/26* (2013.01); *D06F 29/00* (2013.01); *D06F 39/085* (2013.01)

(58) Field of Classification Search
None
See application file for complete search history.

(56) References Cited

U.S. PATENT DOCUMENTS 7,257,969 B2 8/2007 Kim
2005/0274155 A1 12/2005 Namkung
(Continued)

FOREIGN PATENT DOCUMENTS

CN 101672363 3/2010
CN 103422328 12/2013
(Continued)

OTHER PUBLICATIONS

European Search Report dated Aug. 3, 2017 issued in Application No. 17173340.5.
(Continued)

*Primary Examiner* — Cristi J Tate-Sims
(74) *Attorney, Agent, or Firm* — KED & Associates, LLP

(57) ABSTRACT

A laundry treatment apparatus is disclosed. The laundry treatment apparatus includes a cabinet, a tub disposed in the cabinet to provide a washing space, a drum rotatably disposed in the tub to receive laundry placed therein, a detergent pump for supplying detergent to the tub, and a detergent box removably mounted to the detergent pump and configured to contain the detergent. The detergent box includes a body for providing a space containing the detergent and a through-hole formed in a rear side of the body to allow the detergent to flow out therethrough. The body includes a lower surface including a first slanted surface, which is slanted downwards from a front side of the body toward the rear side of the body. The through-hole is located at the lowermost position of the body.

20 Claims, 18 Drawing Sheets

(51) Int. Cl.
*D06F 29/00* (2006.01)
*D06F 39/08* (2006.01)

(56) References Cited

U.S. PATENT DOCUMENTS

2008/0072631 A1* 3/2008 Je ..... D06F 39/02 68/17 R
2012/0180533 A1* 7/2012 Song ..... B67D 3/0003 68/17 R
2015/0114047 A1* 4/2015 Jung ..... D06F 39/028 68/17 R

FOREIGN PATENT DOCUMENTS

| | | |
|---|---|---|
| CN | 103797178 | 5/2014 |
| CN | 203755037 U | 8/2014 |
| CN | 103276564 | 6/2015 |
| CN | 104894813 | 9/2015 |
| EP | 1 607 508 | 5/2005 |
| EP | 2 666 900 | 11/2013 |
| EP | 2 784 205 | 10/2014 |
| EP | 2 868 797 | 5/2015 |
| WO | WO 2014/121823 | 8/2014 |

OTHER PUBLICATIONS

Chinese Office Action dated Mar. 20, 2019 issued in Application No. 201710398047.1.
U.S. Office Action dated May 31, 2019 issued in parent U.S. Appl. No. 15/608,575.
U.S. Notice of Allowance dated Dec. 12, 2019 issued in parent U.S. Appl. No. 15/608,575.
European communication dated Feb. 19, 2020 issued in Application 17 173 340.5.

* cited by examiner (a)

(b)

(a)

(b)

LAUNDRY TREATMENT APPARATUS

CROSS-REFERENCE TO RELATED APPLICATIONS

This application is a Continuation Application of U.S. patent application Ser. No. 15/608,575 filed May 30, 2017, which claims priority under 35 U.S.C. § 119 to Korean Application No. 10-2016-0066815 filed on May 30, 2016, whose entire disclosures are hereby incorporated by reference.

BACKGROUND

1. Field

The present invention relates to a laundry treatment apparatus.

2. Background

Laundry treatment apparatuses are apparatuses that remove contaminants from clothing, bedding or the like (hereinafter, referred to as "laundry") by putting laundry into a drum. Such a laundry treatment apparatus may perform washing, rinsing, dehydration and drying processes. The laundry treatment apparatus typically includes a main body forming the external appearance thereof, a tub disposed inside the main body, a drum rotatably mounted inside the tub and configured to receive laundry put thereinto, and a detergent supply device for supplying detergent to the drum.

The laundry treatment apparatus is classified into a top-loading type and a front-loading type according to the direction in which laundry is put into a drum. The front-loading-type washing machine is generally called a drum-type washing machine. Recently, not only a drum-type washing machine in which only one drum is provided in a main body but also a drum-type washing machine in which an additional sub-drum is provided in a lower portion of a main body in order to wash a small amount of laundry has become commercially available.

A conventional drum-type washing machine includes a detergent supply unit positioned in an upper portion of a main body. A user may draw the detergent supply unit in the forward direction from the main body by pulling the same, and may withdraw a detergent container out of the same. However, this constitution makes it difficult to supply a large amount of detergent through the detergent supply unit. Further, because the detergent supply unit is located at a conspicuous position, that is, a position over the drum in the main body, it degrades the appearance of the product.

A drum-type washing machine according to the present invention is constructed such that a detergent box accommodation part, into which a box for containing liquid detergent that is to be supplied to a drum for the washing process is inserted, is positioned below the drum. The detergent box accommodation part is divided into a detergent box insertion part, into which the detergent box is inserted, and a filter insertion part, into which a filter is inserted. The drum-type washing machine according to the present invention further includes a detergent injection door, which enables a user to open or close the above insertion parts as needed.

A conventional drum-type washing machine includes a detergent box and a detergent pump for pumping detergent out of the detergent box.

However, there is a problem in that detergent leaks through a gap between the detergent box and the detergent pump due to the low coupling force therebetween.

Further, because detergent is not completely pumped out of the conventional detergent box by the detergent pump and a part thereof remains in the detergent box, a user is required to refill the detergent box even when the detergent is not completely used up, which is inconvenient.

Further, it is difficult to clean the interior of the conventional detergent box with water because a check valve is provided at the detergent box in an integral manner.

Furthermore, the conventional detergent box has a sealing structure formed at a detergent supply port; however, an elastic member composing the sealing structure is liable to be separated from the detergent supply port due to its own elastic force when the tub vibrates.

BRIEF DESCRIPTION OF THE DRAWINGS

The embodiments will be described in detail with reference to the following drawings in which like reference numerals refer to like elements wherein.

DETAILED DESCRIPTION

Reference will now be made in detail to the preferred embodiments of the present invention, examples of which are illustrated in the accompanying drawings. For the sake of brief description with reference to the drawings, the same or equivalent components will be denoted by the same reference numbers, and a description thereof will not be repeated. In the specification, a singular expression includes the plural meaning unless the singular expression is explicitly different in context. In addition, when it is determined that a detailed description of technology known in the related art would prevent the nature and gist of the present invention from being made apparent, such detailed description of the technology is omitted. In addition, the accompanying drawings are only for helping get an easy understanding of the idea of the present invention, and notably should not be construed as imposing any limitation on the idea of the invention.

Figure 1:
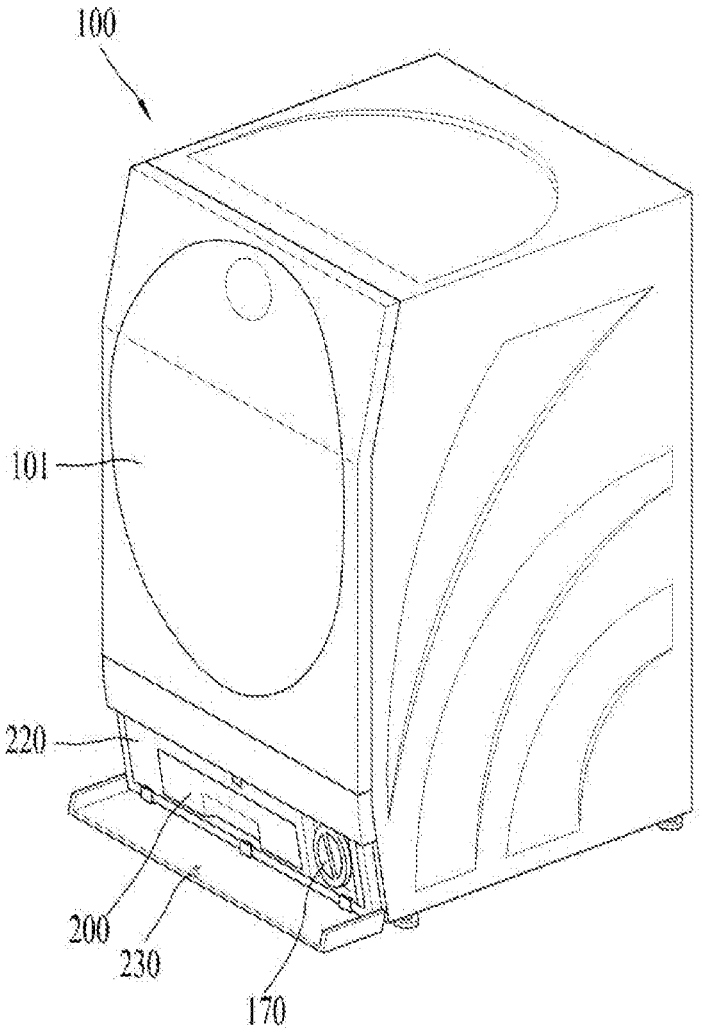
FIGS. 1 to 3 are views illustrating the external appearance, the inner construction and the flow passage of a laundry treatment apparatus according to the present invention.
Figure 2:
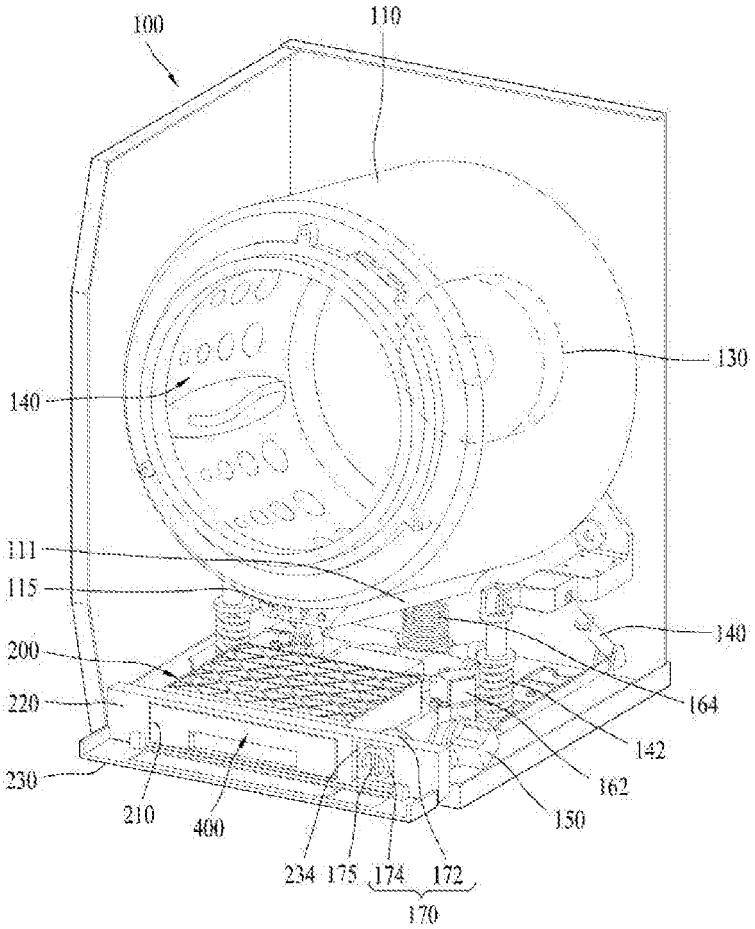

As shown in FIGS. 1 and 2, a laundry treatment apparatus according to an embodiment of the present invention may include a cabinet 100 forming the external appearance thereof, a tub 110 disposed in the cabinet to provide a washing space, a drum 140 rotatably disposed in the tub, and a driving unit 130 for rotating the drum 140.

The cabinet 100 may be formed in an approximately rectangular parallelepiped shape, and the tub 110 may have an opening formed in one side thereof. Although it is illustrated in FIGS. 1 and 2 that the opening is formed in the front side of the tub 110, it does not exclude the structure in which the opening is formed in the upper side of the tub 110. That is, the above drawings are only for illustrating the laundry treatment apparatus according to the embodiment of the present invention, and the disclosure is not limited to the front-loading type.

The cabinet 100 may be provided at a front side thereof with a door 101 for opening and closing the opening in the tub 110. The door 101 may be rotatably coupled to the cabinet 100 by means of a hinge or the like so that the tub 110 may selectively communicate with the outside. Specifically, the door 101 may be rotatably coupled to the cabinet 100 so as to rotate in the lateral direction about a hinge shaft disposed in the vertical direction.

In addition, the laundry treatment apparatus according to the embodiment of the present invention may include a detergent unit 200 for supplying detergent to the tub 110 and a filter unit 170 for removing foreign substances from the wash water discharged from the tub 110.

In a prior art, the detergent unit 200 for supplying detergent to the tub 110 is provided at a position over the tub 110 and supplies detergent to the tub 110 using water that is supplied to the tub 110.

However, in the case in which the detergent contained in the detergent unit 200 remains therein for a long time or is contaminated, whenever water is supplied to the tub 110, the water may be mixed with the contaminated detergent and thus the laundry in the tub 110 may also be contaminated.

The laundry treatment apparatus according to the embodiment of the present invention is constructed such that the detergent unit 200 is provided at a position below the tub 110 and detergent is supplied to the tub 110 using the wash water discharged from the tub 110.

Accordingly, in the laundry treatment apparatus according to the embodiment of the present invention, when water is supplied to the tub 110, it is possible to guide clean water supplied from an external water supply system to the tub 110 without mixing the same with detergent. As a result, since the water supplied to the tub 110 is clean all the time, it is possible to guarantee the safety of the water supplied to the tub 110.

The detergent unit 200 may include a frame 220 disposed below the tub 110, a detergent box accommodation part 210 formed through the frame 220, and a detergent box 400 removably provided in the detergent box accommodation part 210. A detailed explanation of the detergent unit 200 will be made later.

The laundry treatment apparatus according to the embodiment of the present invention may further include a frame cover 230 for opening and closing the frame 220 so as to protect the detergent unit 200 and the filter unit 170 and improve the external appearance thereof.

The frame 220 may have a filter hole 234 formed therein to allow a filter 174 to be drawn out therethrough.

The frame cover 230 may be coupled to the frame 220 so as to rotate in the vertical direction.

The frame cover 230 may be configured to rotate about a hinge shaft provided at a lower end of the frame 220.

Referring to FIG. 2, the tub 110 may be supported by a suspension 140 inside the cabinet 100.

The suspension may include at least one of a plurality of elastic members 142 and a plurality of dampers 144. Therefore, vibration generated by the tub 110 may be prevented from being transmitted to the cabinet 100.

The drum 140 may be rotated by the driving unit 130 disposed at one end (for example, a rear side) of the tub 110. The drum 140 may be formed in a cylindrical shape having an opening formed in one side thereof. The opening in the drum 140 may be aligned with the opening in the tub 110.

A heater 115 may be provided at one side of the tub 110 in order to heat water supplied to the tub 110.

A heater chamber 111 for accommodating the heater 115 may be provided at one side of the tub 110.

Specifically, the heater chamber 111 is positioned below the tub 110 so that water is supplied to the heater chamber 111 first. Therefore, in the water supply process, the heater 115 is immersed in the water first, thereby preventing overheating of the heater 115 and effectively heating the water.

The laundry treatment apparatus according to the embodiment of the present invention may further include a drain pump 150 for discharging wash water from the tub 110 to the outside.

In addition, there may be provided a circulation flow passage 160 for circulating the wash water discharged from the tub 110 back to the interior of the tub 110. A circulation pump 162 for moving water in the upward direction may be provided in the circulation flow passage 160. The circulation flow passage 160 may include a bellows 164 connected to the lower end of the tub 110 and a circulation hose 166 connected to the bellows 164 (refer to FIG. 3).

The filter unit 170 for collecting foreign substances from the wash water discharged from the tub 110 may be provided at one side of the drain pump 150.

The filter unit 170 may include a filter casing 172 and a filter 174 removably accommodated in the filter casing 172. The filter 174 may be provided at the front surface thereof with a filter knob 175.

The filter 174 may be accommodated in the filter casing 172 in a manner such that the filter knob 175 is exposed to the outside of the filter casing 172 and the region behind the filter knob 175 is inserted into the filter casing 172.

The filter casing 172 may be connected to one end of the circulation hose 166 so as to remove foreign substances from the wash water that circulates toward the tub 110. The circulation hose 166 may be provided at the opposite end thereof with a bellows connection part 167 to which the bellows 164 is connected.

The bellows connection part 167 may be formed in the shape of a hemisphere having an opening formed in the upper side thereof. A water level detection hose 169 for detecting the water level in the tub 110 may be connected to the bellows connection part 167. Although not illustrated in the drawings, wash water is introduced into the water level detection hose 169 to the same water level as that in the tub 110, whereby the water level in the tub 110 may be detected.

A drain hose 155 may be connected to the discharge port of the drain pump 150 so as to discharge the wash water to the outside of the cabinet 100.

The circulation flow passage 160 may include a discharge hose 168 disposed at the discharge port of the circulation pump 162. One end of the discharge hose 168 may be connected to the region above the tub 110.

Meanwhile, in the laundry treatment apparatus according to the embodiment of the present invention, the detergent unit 200 may be disposed below the tub 110. The detergent unit 200 may be configured to contain liquid detergent as well as solid detergent. The liquid detergent refers to a material that enhances a laundry washing effect, for example, liquefied detergent, liquefied fabric softener or liquefied fabric bleach.

Hereinafter, for convenience of explanation, liquefied detergent will be referred to as liquid detergent, and liquefied fabric softener and liquefied fabric bleach will be commonly referred to as liquid fabric softener.

Figure 3:
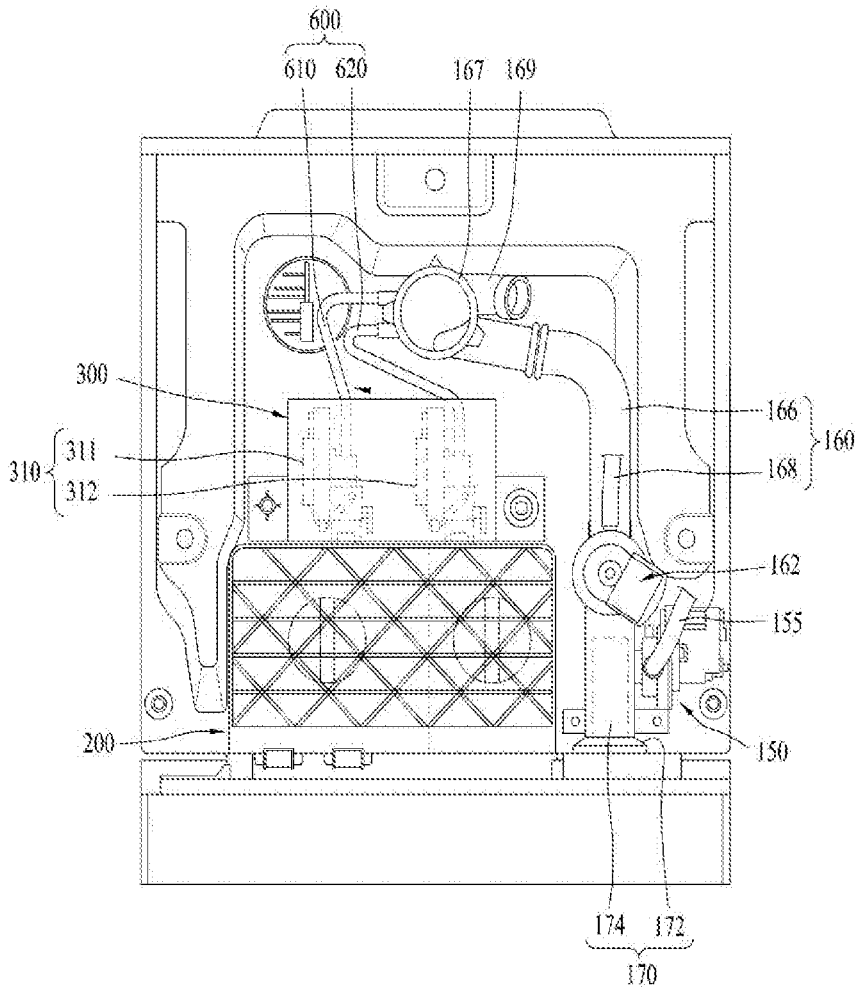
Figure 4:
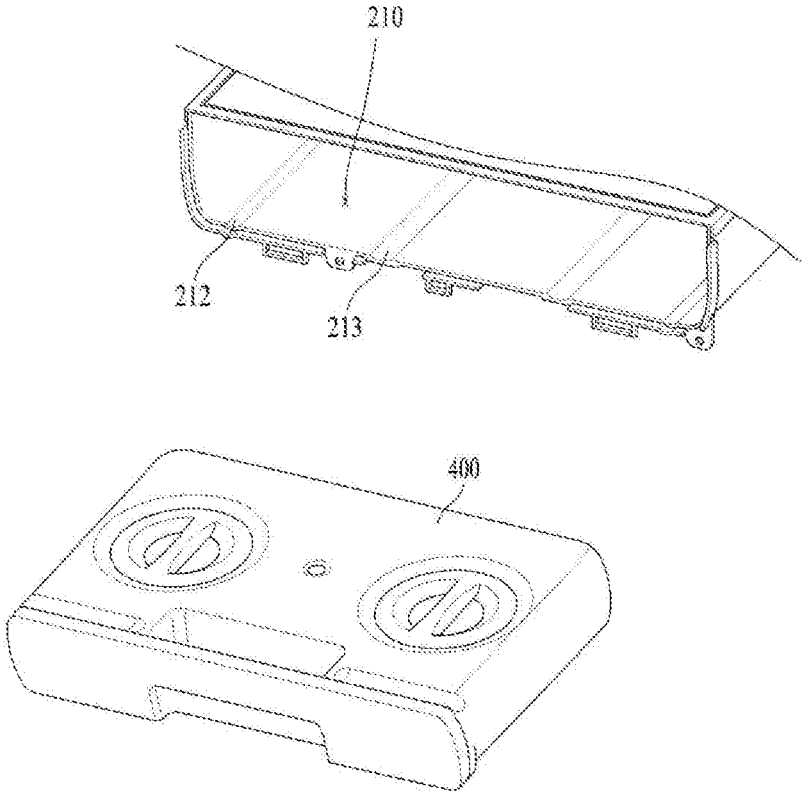
FIG. 4 is a view illustrating a detergent box and a detergent box accommodation part of the laundry treatment apparatus according to the present invention.

Referring to FIGS. 3 and 4, the detergent unit 200 may include a detergent box 400 for containing at least one of the liquid detergent and liquid fabric softener and configured so as to be drawn out of the cabinet 110, and a detergent box accommodation part 210 for accommodating the detergent box 400.

The detergent box accommodation part 210 may be configured as a housing, which is provided below the tub 110 and includes a detergent box insertion part 211 formed in the front side thereof to allow the detergent box 400 to be inserted thereinto.

The laundry treatment apparatus according to the embodiment of the present invention may include a detergent pump unit 300, which is disposed behind the detergent box accommodation part 210 so as to pump the detergent out of the detergent box 400 and supply the detergent to the tub 110.

The detergent pump unit 300 may include a detergent pump 310, which is mounted to the rear side of the detergent box accommodation part 210 and is configured to be brought into contact with or be coupled to the detergent box 400 when the detergent box 400 is inserted into the detergent box accommodation part 210, and a remaining detergent detection part 301 for detecting the amount of detergent remaining in the detergent box.

In the case in which the detergent box 400 is divided into a first space 401 for accommodating liquid detergent and a second space 402 for accommodating liquid fabric softener (refer to FIG. 14), the detergent pump 310 may include a liquid detergent pump 311 for supplying the liquid detergent contained in the first space 401 to the tub 110 and a fabric softener pump 312 for supplying the fabric softener contained in the second space 402 to the tub 110.

That is, the configuration of the detergent pump 310 may be varied in accordance with the kind of detergent that is contained in the detergent box 400.

The detergent pump unit 300 may be connected with a detergent supply flow passage 600, through which the liquid detergent and the fabric softener in the detergent box 400 are supplied to the tub 110. The detergent supply flow passage 600 may be connected to the detergent pump 310.

The detergent supply flow passage 600 may be connected at one end thereof to the discharge port of the detergent pump 310 mounted to the detergent box accommodation part 210, and may be connected at the opposite end thereof to the bellows connection part 167.

In particular, the detergent supply flow passage 600 may include a liquid detergent flow passage 610, which connects the liquid detergent pump 311 to the bellows connection part 167, and a fabric softener flow passage 620, which connects the fabric softener pump 312 to the bellows connection part 167.

That is, since the liquid detergent flow passage 610 and the fabric softener flow passage 620 are respectively connected to the bellows connection part 167, the liquid detergent and the fabric softener may be mixed and diluted with the wash water in the bellows connection part 167 before being introduced into the tub 110, and may then be supplied to the tub 110.

Owing to the above-described construction, since the liquid detergent and the fabric softener are first diluted with wash water and are then brought into contact with laundry, there is no risk of damage to laundry attributable to direct contact between highly concentrated detergent and laundry.

Further, by virtue of the circulating operation by the circulation pump, the wash water discharged from the tub 110 flows back to the tub 110 via the bellows connection part 167, with the result that the liquid detergent and the fabric softener may be introduced into the tub 110.

The detergent box accommodation part 210 may have guide grooves 212 and seating recess guide grooves 213 formed therein, along which guide ribs and seating recesses 4410 of the detergent box 400 respectively slide, which will be described later.

The guide grooves 212 and the seating recess guide grooves 213 may serve to guide the direction in which the detergent box 400 is inserted into or drawn out of the detergent box accommodation part 210 and to guide the detergent box 400 so as to be coupled to the detergent pump 310 at the correct position.

Hereinafter, the detergent pump 310 according to the embodiment of the present invention will be described with reference to FIGS. 5 to 9.

The detergent pump 310 may be divided into the liquid detergent pump 311 and the fabric softener pump 312; however, such division is made in accordance with the functions thereof, and the construction and the operational principle thereof are the same. The description of the construction of the detergent pump 310 will now be made, and it should be noted that the liquid detergent pump 311 and the fabric softener pump 312 are encompassed within the following description.

Figure 5:
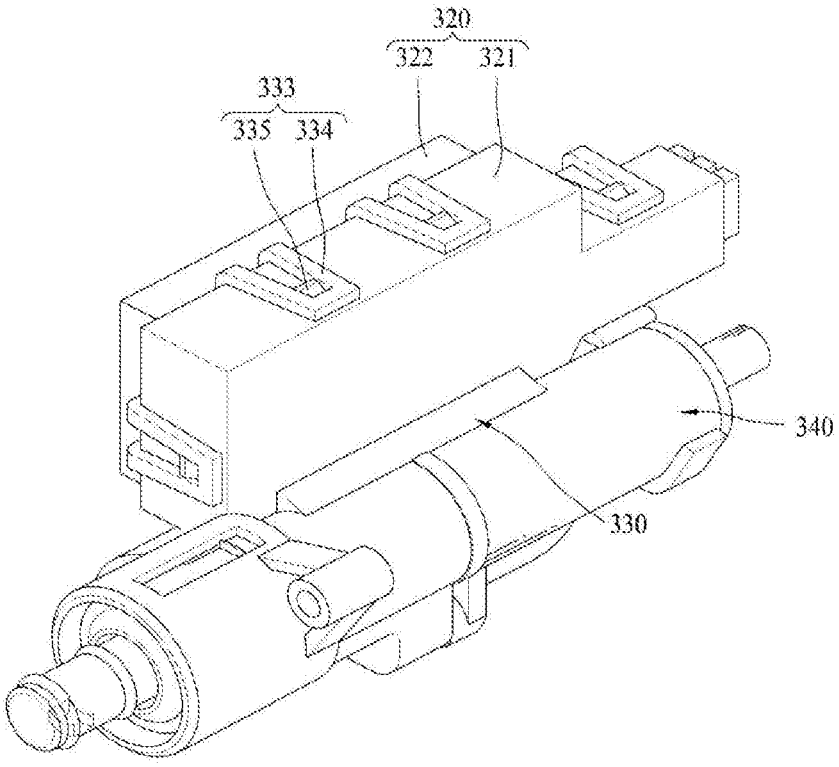
FIGS. 5 to 9 are views illustrating a detergent pump of the laundry treatment apparatus and the operation thereof according to the present invention.

As shown in FIG. 5, the detergent pump 310 according to the embodiment of the present invention may include a pump body 340, which receives detergent from the detergent box 400 and supplies the detergent to the tub 110, a cylinder 320, which allows the detergent to flow into or out of the pump body 340 by applying pressure to the pump body 340, and a communication part 330, which allows the pump body 340 and the cylinder 320 to communicate with each other.

Figure 6:
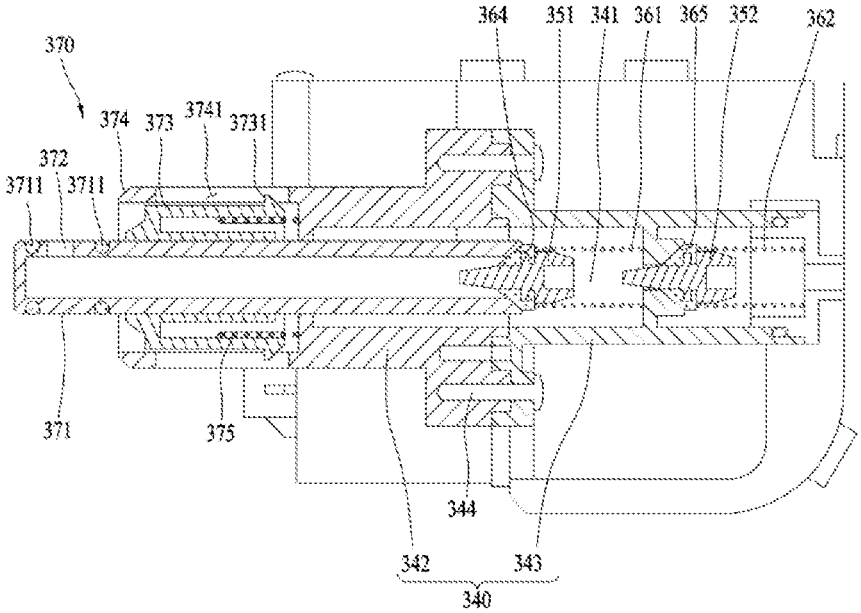

Referring to FIG. 6, the pump body 340 may include an inflow part 342 and an outflow part 343, which are coupled to each other in the longitudinal direction of the pump body 340. The inflow part 342 and the outflow part 343 may be formed in an integral manner or may be coupled to each other using a fastening member 344. The inflow part 342 and the outflow part 343 may define a flow passage for the liquid detergent or the fabric softener and a pressurization space 341.

The inflow part 342 is a portion through which the liquid detergent or the fabric softener flows from the detergent box 400 into the pump body 340, and the outflow part 343 is a portion through which the liquid detergent or the fabric softener flows out of the pump body 340.

The pressurization space 341 may have a suction port 364 formed in the upstream part thereof and a discharge port 365 formed in the downstream part thereof. A suction valve 351 may be provided near the suction port 364 to open and close the suction port 364.

The suction valve 351 may be disposed inside the pressurization space 341.

A suction valve spring 361 may be provided to apply an elastic force to a portion of the suction valve 351 so that the suction valve 351 is biased to shut the suction port 364.

The suction valve 351 may be returned to its original position, at which the suction valve 351 shuts the suction port 364, by the suction valve spring 361.

A discharge valve 352 may be provided near the discharge port 365 to open and close the discharge port 365.

The discharge vale 352 may be disposed outside the pressurization space 341 (i.e. downstream of the discharge port 365).

A discharge valve spring 362 may be provided to apply an elastic force to a portion of the discharge valve 352 so that the discharge valve 352 is biased to shut the discharge port 365. The discharge valve 352 may be returned to its original position, at which the discharge valve 352 shuts the discharge port 365, by the discharge valve spring 362.

In other words, the outflow part 343 may be provided with the suction valve 351 for opening and closing the suction port of the pressurization space 341 and the discharge valve 352 for opening and closing the discharge port of the pressurization space 341.

The pump body 340 may be formed in an approximately cylindrical shape. The inflow part 342 and the outflow part 343 may each be formed in a cylindrical shape.

A connection part 370 for connection with the detergent box 400 may be formed at one side of the inflow part 342. The connection part 370 may be inserted through the rear side of the detergent box accommodation part 210.

Figure 9:
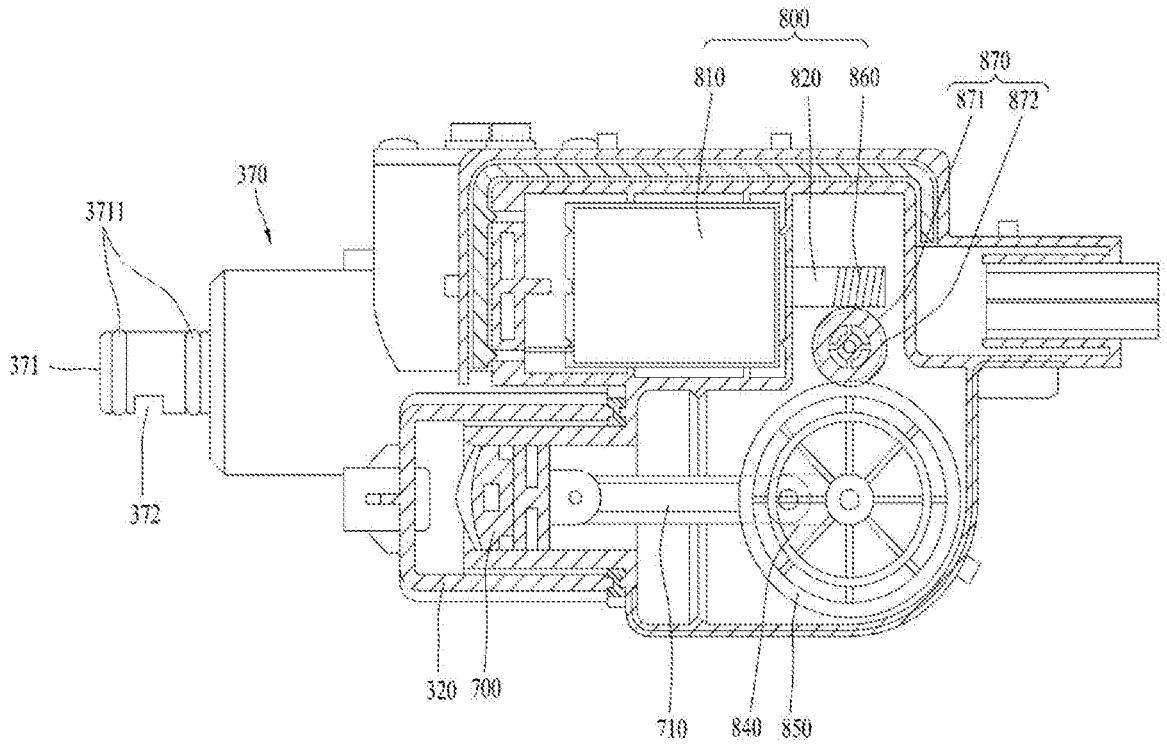

Referring to FIGS. 5 and 9, the cylinder 320 may include a cylinder body 321, which forms an accommodation space thereinside, and a body cover 322, which is coupled to the cylinder body 321.

A piston 700 for generating pressure variation in the pressurization space 341 and a piston-driving unit 800 for moving the piston 700 in a reciprocating manner may be provided inside the cylinder 320.

The piston 700 may be formed in any configuration as long as it can generate pressure variation in the pressurization space 341. The piston-driving unit 800 may be formed in any configuration as long as it can move the piston 700 in a reciprocating manner.

Referring to FIG. 9, the piston-driving unit 800 according to the embodiment of the present invention may include an electric motor 810, which generates a driving force when electric power is applied thereto, and a power transmission unit 820, which transmits the driving force from the electric motor 810 to the piston 700.

The power transmission unit 820 may include a piston rod 710, which is connected at one end thereof to the piston 700, a crankshaft 840, which is connected to the opposite end of the piston rod 710, a driven gear 850, which is provided at a rotating shaft of the crankshaft 840 so as to rotate therewith, a driving gear 860, which is provided at a rotating shaft of the electric motor 810, and a power transmission gear 870, which meshes with the driving gear 860 and the driven gear 850 so as to transmit the rotational force of the driving gear 860 to the driven gear 850.

The driving gear 860 may be a worm formed on the rotating shaft of the electric motor 810.

The power transmission gear 870 may include a first gear 871, which is configured as a worm wheel that meshes with the worm so as to rotate therewith, and a second gear 872, which is integrally coupled to a rotating shaft of the worm wheel so as to rotate therewith and also meshes with the driven gear 850 so as to rotate the same.

The case body 331 and the case cover 332 may be provided with an engagement unit 333 for engagement therebetween.

The engagement unit 333 may include a coupling rib 334, which extends from one of the case body 331 and the case cover 332 toward the other one thereof, and an engagement protrusion 335, which protrudes from the other one thereof so as to be engaged with the coupling rib 334.

The coupling rib 334 may have a protrusion insertion hole 336 formed therethrough to allow the engagement protrusion 335 to be fitted thereinto.

In this embodiment, the coupling rib 334 is formed at the case cover 332 and the engagement protrusion 335 is formed at the case body 331; however, this is merely illustrative. Alternatively, the coupling rib 334 may be formed at the case body 331 and the engagement protrusion 335 may be formed at the case cover 332.

The pump body 340 may be coupled to one side of the case body 331 in an integral manner.

The pump body 340 may include a communication passage 330, which communicates with the cylinder 310, that is, the case body 331.

That is, the pump body 340 communicates with the cylinder 310 via the communication passage 330, whereby pressure variation that has occurred in the cylinder 310 may be transmitted to the interior of the pump body 340.

In other words, the pressurization space 341 may communicate with the cylinder 310. Accordingly, when the piston 700 moves in a reciprocating manner, a suction force and a compressive force may be repeatedly applied to the interior of the pressurization space 341.

Referring to FIG. 6, the connection part 370 may include an inflow column 371, which communicates with the pressurization space 341 and protrudes in the forward direction of the pump body 340, an inflow hole 372, which is formed through one side of the inflow column 371 and allows the pressurization space 341 to communicate with the outside, an inflow hole opening/closing part 373, which is configured to slide along the outer circumferential surface of the inflow column 371 so as to open and close the inflow hole 372, a protecting part 374, which is formed around the outer circumferential surface of the inflow hole opening/closing part 373 so as to accommodate the inflow hole opening/closing part 373, and an opening/closing spring 375, which is provided around the outer circumferential surface of the inflow column 371 while one end thereof is in contact with the pump body 340 and the opposite end thereof is in contact with the inflow hole opening/closing part 373 so as to allow the inflow hole opening/closing part 373 to slide over the inflow hole 372.

That is, since the connection part 370 protrudes in the forward direction of the pump body 340, when the detergent pump 310 is mounted to the rear side of the detergent box accommodation part 210, the connection part 370 may pass through the detergent box accommodation part 210.

As a result, the connection part 370 may be connected to and communicate with the detergent box 400.

Specifically, the inflow column 371 may extend from the pump body 340, and may be formed in the configuration of a pipe that communicates with the pressurization space 341. That is, the inflow column 371 may have a flow passage defined by the inner circumferential surface thereof, which communicates with the pressurization space 341.

When the detergent box 400 is placed in the detergent box accommodation part 210, the inflow column 371 may be inserted into the detergent box 400. Therefore, the extension length of the inflow column 371 from the pump body 340 may be sufficient to be inserted into the detergent box 400. The inflow column 371 may extend from the inflow part 342.

Since the inflow column 371 is inserted into the detergent box 400, it is possible to prevent the detergent supplied from the detergent box 400 from leaking out of the connection part 370.

The inflow hole 372 may be formed through a portion of the inflow column 371 that is near the distal end of the inflow column 371 so as to communicate with the pressurization space 341.

The inflow hole 372 may be formed in a portion of the distal end of the inflow column 371, or may be formed in the outer circumferential surface near the distal end of the inflow column 371.

That is, the entire area of the inflow column 371, excluding the inflow hole 372, is shielded, thereby preventing foreign substances from being introduced into the pressurization space 341.

Because the liquid detergent or the fabric softener has a very high viscosity, foreign substances may easily adhere thereto. Thus, foreign substances may easily adhere to the inflow hole 372, through which the liquid detergent or the fabric softener passes.

Since the inflow hole 372 is configured as a through-hole having a predetermined area, which corresponds to the area of an inflow hole 521 in a check valve 500, which will be described later, it may be easily blocked by foreign substances. Further, the detergent or the fabric softener in the pressurization space 341 may leak through the inflow hole 372.

Therefore, when the detergent box 400 and the connection part 370 are not connected to each other, it is necessary to shield the inflow hole 372 from the outside.

Accordingly, the inflow hole opening/closing part 373 is provided to shield the inflow hole 372 from the outside.

When the connection part 370 is inserted into the detergent box 400, the detergent box 400 pushes the inflow hole opening/closing part 373 in the rearward direction so as to open the inflow hole 372. When the detergent box 400 is separated from the connection part 370, the inflow hole opening/closing part 373 shuts the inflow hole 372 (refer to FIG. 16).

To this end, the inflow hole opening/closing part 373 may include a spring accommodation part 3731 in which the opening/closing spring 375 is accommodated.

The spring accommodation part 3731 may be formed in a "C" shape so as to prevent the opening/closing spring 375 accommodated therein from being separated therefrom.

The opening/closing spring 375, which is accommodated in the spring accommodation part 3731, is in contact at one end thereof with the inflow hole opening/closing part 373 and is in contact at the opposite end thereof with the pump body 340. Therefore, the opening/closing spring 375 may be compressed or expanded by variation in external force that is applied to the inflow hole opening/closing part 373.

When no external force is applied to the inflow hole opening/closing part 373, the opening/closing spring 375 may be expanded to a sufficient length to enable the inflow hole opening/closing part 373 to shut the inflow hole 372. When external force is applied to the inflow hole opening/closing part 373, the opening/closing spring 375 may be compressed so as to enable the inflow hole opening/closing part 373 to open the inflow hole 372.

The inflow hole opening/closing part 373 may have a coupling protrusion 3732 formed on the outer circumferential surface thereof, and the protecting part 374 may have a protrusion guide 3741 for guiding the movement of the coupling protrusion 3732.

Accordingly, whenever external force is applied to or released from the inflow hole opening/closing part 373 via the detergent box 400, the protecting part 374 may guide the inflow hole opening/closing part 373 so that the inflow hole opening/closing part 373 moves stably.

The inflow hole opening/closing part 373 slides along the outer circumferential surface of the inflow column 371 due to repulsive force or elastic force of the opening/closing spring 375. At this time, there is a risk that the inflow hole opening/closing part 373 may be separated from the protecting part 374 due to the momentary repulsive force or elastic force of the opening/closing spring 375. However, the coupling protrusion 3731 and the protrusion guide 3741 may serve to prevent the inflow hole opening/closing part 373 from being separated from the protecting part 374 and consequently to ensure stable accommodation of the inflow hole opening/closing part 373 in the protecting part 374.

Since the inflow hole opening/closing part 373 and the protecting part 374 are connected to the detergent box 400, it is possible to prevent the detergent or the fabric softener in the detergent box 400 from leaking outside.

The inflow column 371 may be provided with sealing rings 3711, which are disposed in front of and behind the inflow hole 372. The sealing rings 3711 may prevent the detergent in the detergent box 400 from leaking along the inflow column 371 due to the weight thereof and the pressure.

The protecting part 374 may extend from one side of the pump body 340 to accommodate a portion of the outer circumferential surface of the inflow column 371. Further, the length that the protecting part 374 extends from one side of the pump body 340 may be equal to or greater than the length of the inflow hole opening/closing part 373.

The protecting part 374 may have a diameter large enough to accommodate the inflow column 371, the inflow hole opening/closing part 373 and the opening/closing spring 375.

Hereinafter, a process in which the detergent or the fabric softener in the pump body 340 is supplied to the tub 110 in accordance with the above-described construction will be described with reference to FIGS. 7 and 8.

When electric power is applied to the electric motor 810 in the cylinder 320 and the electric motor 810 rotates, the driving gear 860, the power transmission gear 870 and the driven gear 850 may rotate, and consequently the crankshaft 840 may rotate. Due to the rotation of the crankshaft 840, the piston rod 710 may move in a reciprocating manner, and the piston 700 may move in a reciprocating manner inside the cylinder 320.

Figure 7:
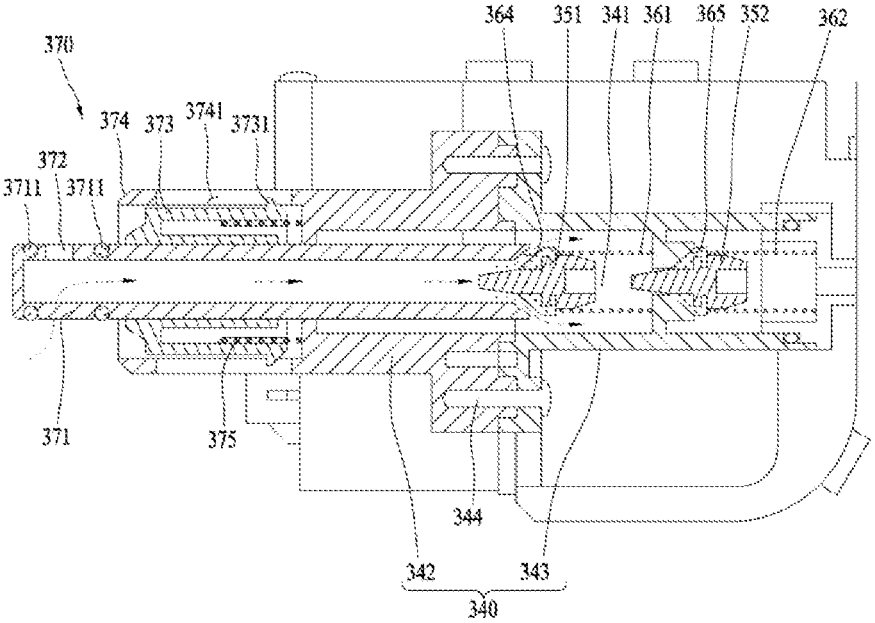

When the piston 700 moves in the direction in which the internal volume of the cylinder 320 is expanded, as shown in FIG. 7, suction force is generated in the pressurization space 341, which communicates with the interior of the cylinder 320 via the communication passage 330. As a result, the suction valve 351 opens the suction port 364.

When the suction port 364 is open, the liquid detergent or the fabric softener in the detergent box 400 may flow into the pump body 340 via the connection part 370 and may be sucked into the pressurization space 341 via the open suction port 364.

Figure 8:
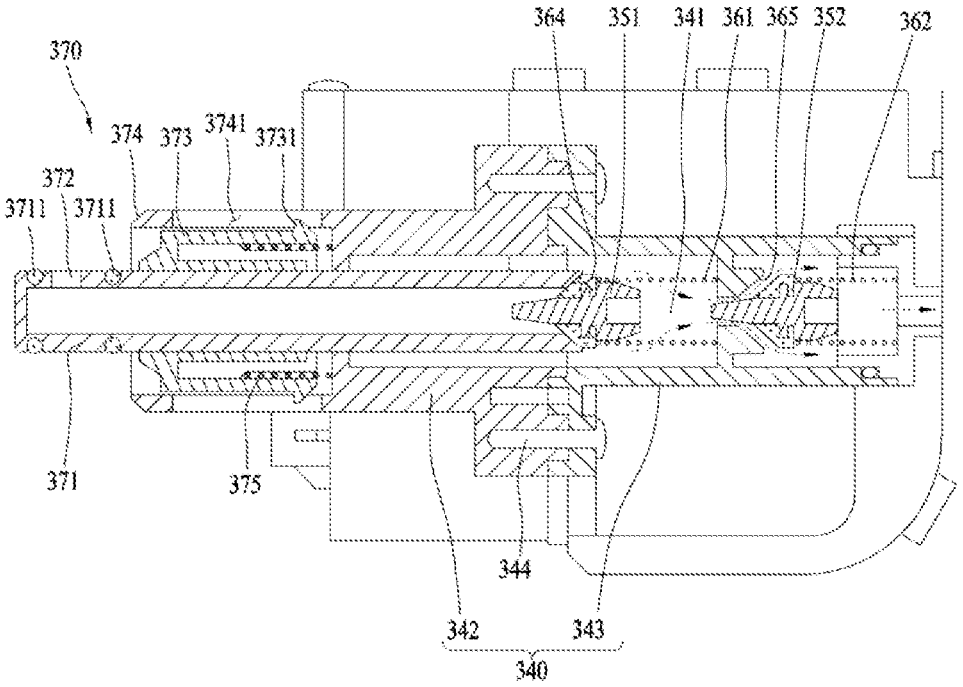

When the piston 700 moves in the direction in which the internal volume of the cylinder 320 is contracted, as shown in FIG. 8, the interior of the pressurization space 341 may be compressed, and the discharge valve 352 may open the discharge port 365 due to the compressive force of the piston 700.

When the discharge port 365 is open, the liquefied detergent (that is, the liquid detergent or the fabric softener), to which the compressive force is applied by the piston 700, may move through the detergent supply flow passage 600 (that is, the liquid detergent flow passage 610 and the fabric softener flow passage 620) via the discharge port 3412, and may flow into the bellows connection part 167.

The liquid detergent or the fabric softener introduced into the bellows connection part 167 may be mixed with wash water and may flow into the tub 110 along the circulation flow passage 160.

When the operation of the electric motor 810 is stopped, the suction valve 351 and the discharge valve 352 may be returned to their respective original positions by the elastic force of the suction valve spring 361 and the elastic force of the discharge valve spring 362, thereby respectively shutting the suction port 3411 and the discharge port 3412.

Hereinafter, the detergent box 400 will be described in detail with reference to FIGS. 10 to 14.

Figure 10:
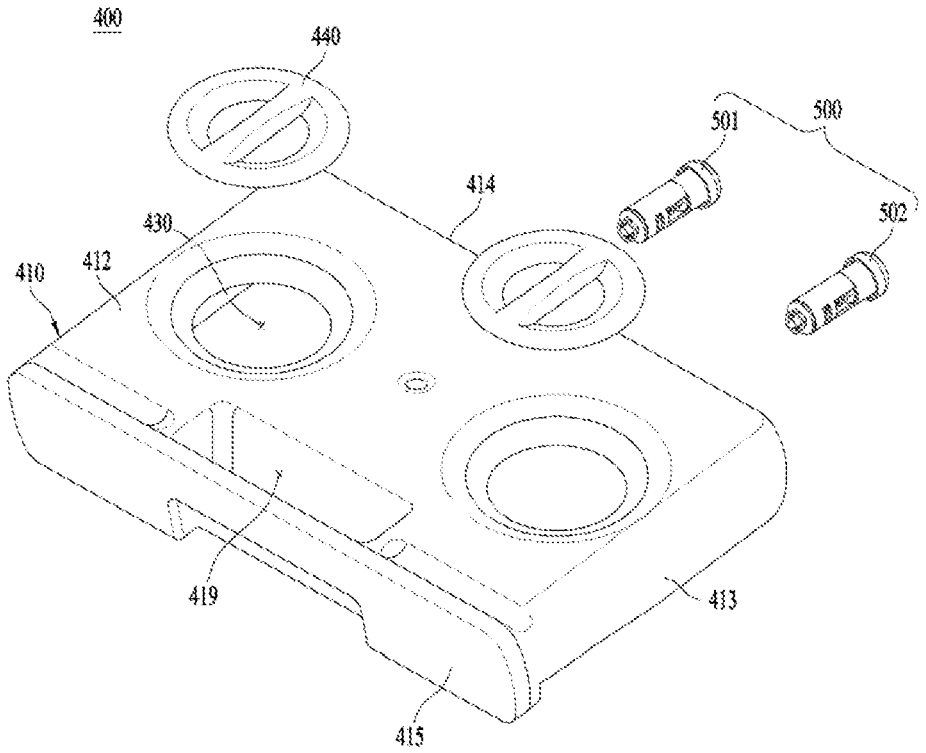
FIGS. 10 to 14 are views illustrating the detergent box of the laundry treatment apparatus according to the present invention.

Referring to FIG. 10, the detergent box 400 may include a body 410, which provides spaces for containing the liquid detergent and the fabric softener, through-holes 420, which are formed in the rear side of the body and through which the liquid detergent and the fabric softener contained in the body are discharged, and injection holes 430, which are formed in the body and through which the liquid detergent and the fabric softener are injected into the body.

The injection holes 430 may be formed in any region of the body 410 as long as the liquid detergent and the fabric softener can be injected into the body 410 therethrough. It is noted that the injection holes 430 may be formed in an upper surface 412 of the body 410 so that a user may easily inject the liquid detergent and the fabric softener into the body 410.

The detergent box 400 may further include check valves 500, which are fitted into the corresponding through-holes 420 in order to allow the liquid detergent and the fabric softener in the body 410 to flow in one direction, and caps 440, which are removably coupled to the corresponding injection holes 430 in order to prevent the liquid detergent and the fabric softener in the body 410 from flowing out of the body 410.

The body 410 may be formed in a hexahedral shape including an upper surface 412, a lower surface 411, left and right surfaces 413, a front surface 415, and a rear surface 414. Such a body 410 may be shaped such that the width thereof is greater than the height thereof. This is for facilitating the division of the body 410 into the space for containing the liquid detergent and the space for containing the fabric softener and for enabling the body 410 to match the detergent box accommodation part 210.

However, if the detergent box 400 is shaped such that the height thereof is greater than the width thereof, interference between the detergent box 400 and the tub 110 may occur.

The injection holes 430 may include a first injection hole 431, which is formed in a region of the upper surface 412 of the body 410 that defines a first space, and a second injection hole 432, which is formed in a region of the upper surface 412 of the body 410 that defines a second space.

The check valves 500 may include a first check valve 501, which is removably fitted into a first through-hole 421, and a second check valve 502, which is removably fitted into a second through-hole 422.

Figure 12:
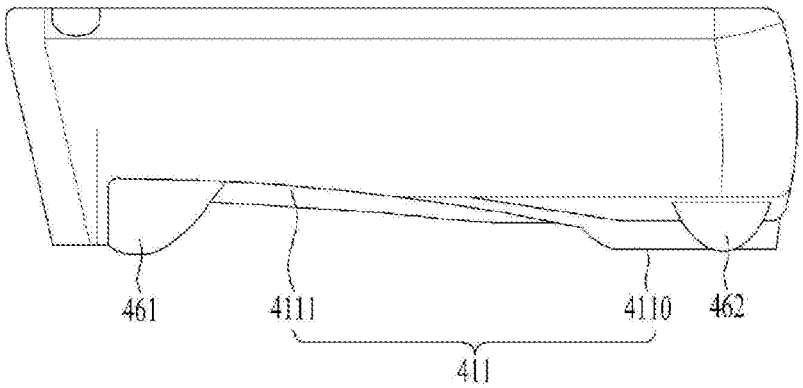

Referring to FIG. 12, the lower surface 411 of the body 410 may include a first slanted surface 4111, which is slanted downwards from the front side of the body toward the rear side of the body. That is, the height of the first slanted surface 4111 may decrease from the front side of the body to the rear side of the body.

The through-holes 420 may be formed in a region at which the rear end of the lower surface 411 and the rear surface 414 meet, that is, the lower end of the rear surface 414.

As a result of the through-holes 420 being formed in the lowermost position of the body 410, it is possible to prevent the liquid detergent or the fabric softener from remaining in the body 410.

That is, owing to the first slanted surface 4111 and the through-holes 420 formed in the lowermost position of the body 410, the liquid detergent or the fabric softener in the body 410 may flow down along the first slanted surface 4111 of the lower surface 411 due to the weight thereof, and may be completely discharged from the body 410 through the through-holes 420.

As such, by enabling the liquid detergent or the fabric softener in the body 410 to be completely discharged from the body 410 through the through-holes 420, it is possible to prevent waste of the liquid detergent or the fabric softener and to reduce the possibility of the liquid detergent or the fabric softener remaining in the body 410.

In addition, when a user cleans the interior of the body 410 with water, the water containing the liquid detergent or the fabric softener is completely discharged outside through the through-holes 420, thereby enhancing the cleaning efficiency.

In this way, it is possible to ensure the cleanliness of the detergent box 400 and to prevent contamination of the tub 110.

The detergent box 400 may further include guide ribs 460, which protrude outwards from the lower surface 411 of the body 410.

The guide ribs 460 may serve to enable the detergent box 400 to be inserted into the correct position in the detergent box accommodation part 210, whereby the through-hole 420 and the connection part 370 of the detergent pump 310 may be accurately connected to each other.

The guide ribs 460 may be configured to move along guide grooves 212 formed in the detergent box accommodation part 210.

The guide ribs 460 may protrude from the front region and the rear region of the lower surface 411 of the body 410.

That is, the guide ribs 460 may include first guide ribs 461 positioned at the front region and second guide ribs 462 positioned at the rear region. This is for enabling the detergent box 400 to be accurately inserted into the detergent box accommodation part 210 without being inclined sideways.

Further, each of the first guide ribs 461 may be aligned with a corresponding one of the second guide ribs 462 so that they are commonly guided by a corresponding one of the guide grooves 212.

Furthermore, in order to compensate for the inclination of the first slanted surface 4111, the first guide ribs 461 and the second guide ribs 462 may protrude different lengths from the lower surface 411 of the body 410.

Specifically, the first guide ribs 461 may protrude farther than the second guide ribs 462 from the lower surface 411 of the body 410.

Therefore, when the detergent box 400 is inserted into and accommodated in the detergent box accommodation part 210, the detergent box 400 may be maintained parallel to a ground despite the slanted lower surface 411.

Further, it is possible to prevent a problem in which the front side of the detergent box 400 sags down due to the first slanted surface 4111 and the through-hole 420 comes to be oriented upwards.

Figure 13:
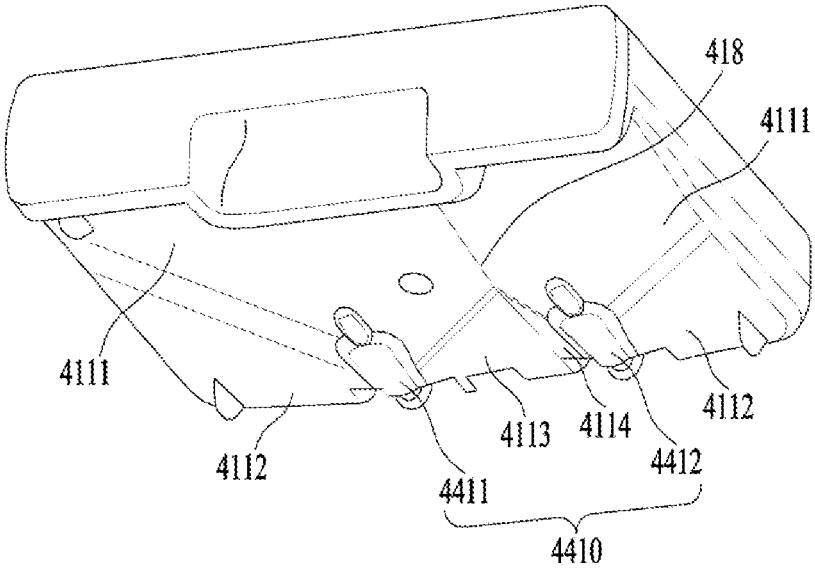
Figure 14:
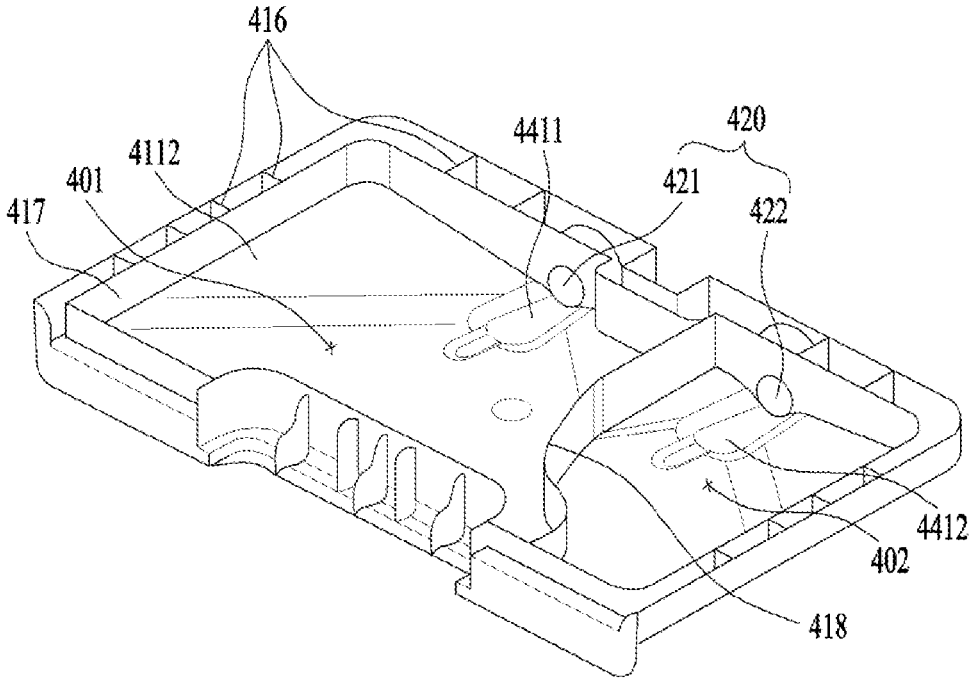

Referring to FIGS. 13 and 14, the body 410 may include a partition wall 418, which is provided thereinside in order to divide the internal space into two spaces for respectively containing the liquid detergent and the fabric softener.

Specifically, the partition wall 418 may divide the internal space of the body 410 into the first space 401, in which the liquid detergent may be contained, and the second space 402, in which the fabric softener may be contained.

Therefore, both the liquid detergent and the fabric softener may be contained in the single detergent box 400.

The partition wall 418 may extend from the front surface 415 of the body 410 to the rear surface 414 thereof.

This is for enabling both the liquid detergent and the fabric softener contained in the first space 401 and the second space 402 to come into contact with the detergent pump 310.

The partition wall 418 may be positioned closer to one lateral surface of the body 410, and may be formed in various curved shapes.

The partition wall 418 may be formed such that the first space 401 has a larger volume than the second space 402.

The reason of this is that the amount of detergent that is typically used in a laundry treatment apparatus is more than the amount of fabric softener.

The through-holes 420 may include a first through-hole 421, which is formed in a region of the lower end of the rear surface 414 of the body 410 that corresponds to the first space 401, and a second through-hole 422, which is formed in a region of the lower end of the rear surface 414 of the body 410 that corresponds to the second space 402.

The body 410 may have seating recesses 4410, each having a shape corresponding to the check valve 500, formed in the lower surface of the body 410.

Since the check valve 500 is formed in a cylindrical shape having a predetermined length, the seating recess 4410 in which the check valve 500 is seated may be formed in the lower surface 411 of the body 410.

Therefore, although the first slanted surface 4111 is provided at the lower surface 411 of the body 410, the check valve 500 may be stably coupled to the through-hole 420 due to the seating recess 4410.

The region of the lower surface 411 of the body that defines the seating recess 4410 may protrude outwards and may be positioned in front of the through-hole 420.

The seating recess 4410 may extend from the rear end of the first slanted surface 4111 to the rear end of the lower surface 411 of the body 410.

The lower surface 411 of the body 410 may further include a second slanted surface 4112, which extends in a downwardly slanted manner from at least one of the left and right surfaces 413 of the body 410 toward the seating recess 4410 (refer to FIG. 13).

That is, the second slanted surface 4112 may extend in a manner such that the height thereof decreases from the lower end of each of the left and right surfaces 413 of the body 410 to the seating recess 4410.

Accordingly, the seating recess 4410 and the through-hole 420 may be located at the lowermost position or the lower end of the body 410.

In the case in which the detergent box 400 includes the partition wall 418, the seating recesses 4410 may include a first seating recess 4411, which is formed in the first space, and a second seating recess 4412, which is formed in the second space.

In this case, the lower surface 411 of the body 410 may further include a third slanted surface 4113 and a fourth slanted surface 4114, which are respectively slanted downwards from the partition wall 418 toward the first seating recess 4411 and the second seating recess 4412.

That is, the third slanted surface 4113 may extend in a manner such that the height thereof decreases from the partition wall 418 to the first seating recess 4411, and the fourth slanted surface 4114 may extend in a manner such that the height thereof decreases from the partition wall 418 to the second seating recess 4412.

Accordingly, the liquid detergent and the fabric softener contained in the body 410 may be collected toward the first seating recess 4411 and the second seating recess 4412.

The body 410 may further include body-reinforcing ribs 416, which are formed on the inner peripheral surface of the body 410 to reinforce the strength of the body 410, and an extension rib 417, which extends so as to connect the ends of the body-reinforcing ribs 416 and to define the containing space in the body 410 (refer to FIG. 14).

Therefore, it is possible to prevent the detergent box 400 from being damaged due to external shocks or vibrations. Further, in the case in which the body 410 is formed in a manner such that two separate upper and lower sections are coupled, the contact area therebetween may be increased and thermal welding therebetween may be facilitated.

In addition, the body 410 may further include a knob 419, which is formed through the front regions of the upper surface 412 and the lower surface 411.

Accordingly, a user may smoothly insert or draw the detergent box 400 into or out of the detergent box accommodation part 210 by grabbing the knob 419.

Figure 15:
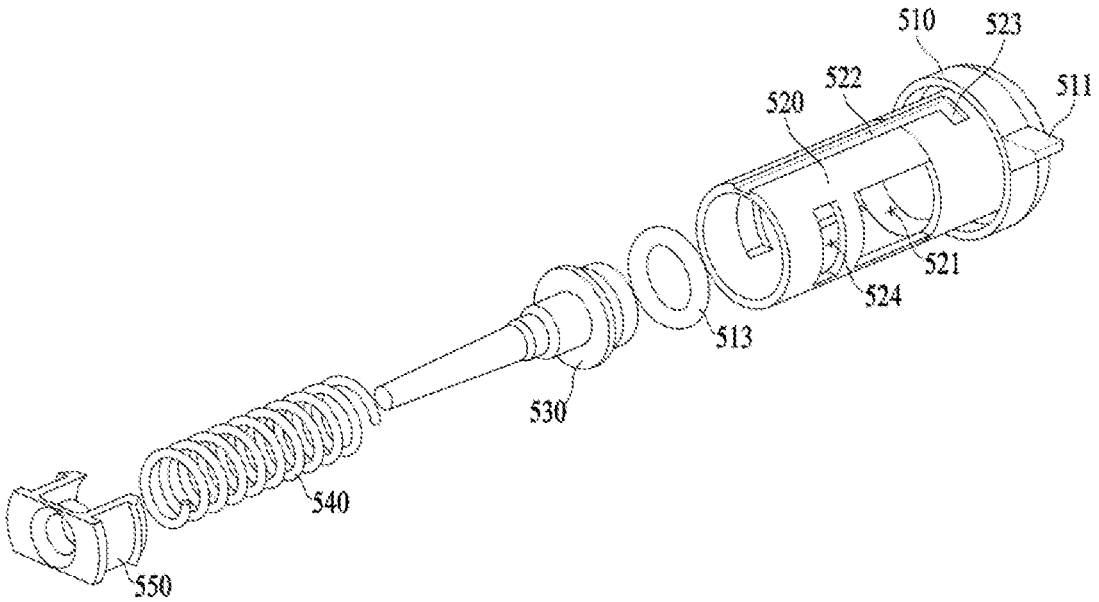
FIG. 15 is a view illustrating a check valve mounted to the detergent box of the laundry treatment apparatus according to the present invention.

Hereinafter, the structure of the check valve 500 will be described in detail with reference to FIG. 15.

The check valve 500 may include a head 510, which has an outflow hole 512 through which the detergent in the detergent box 400 flows out, an insertion part 520, which extends from one side of the head 510 and is inserted into the through-hole 420, a valve piston 530, which is accommodated in the insertion part 520 and opens and closes the outflow hole 512, a support part 550, which is provided at one end of the insertion part 520 so as to be parallel to the head 510, and a valve spring 540, which is provided around the outer circumferential surface of the valve piston 530 so as to be in contact at one end thereof with the support part 550 and to be in contact at the opposite end thereof with the valve piston 530, thereby moving the valve piston 530 in a reciprocating manner inside the insertion part 520.

The insertion part 520 may have a smaller diameter than the head 510. A sealer 513 may be provided between the head 510 and the insertion part 520. The sealer 513 may serve to seal a space between a connection part 423 of the through-hole 420, which will be described later, and the head 510.

The insertion part 520 may have an inflow hole 521 formed through one side of the insertion part 520.

Accordingly, when the valve piston 530 is located at a lower position, the inflow hole 521 and the outflow hole 512 may be open. When the valve piston 530 moves upwards, the inflow hole 521 and the outflow hole 512 may be closed.

That is, the check valve 500 has a structure in which the liquid flows thereinto through the inflow hole 521 formed in the insertion part 520 and then flows out through the outflow hole 512.

Hereinafter, the construction in which the check valve 500 is removably coupled to the detergent box 400 will be described.

Figure 11:
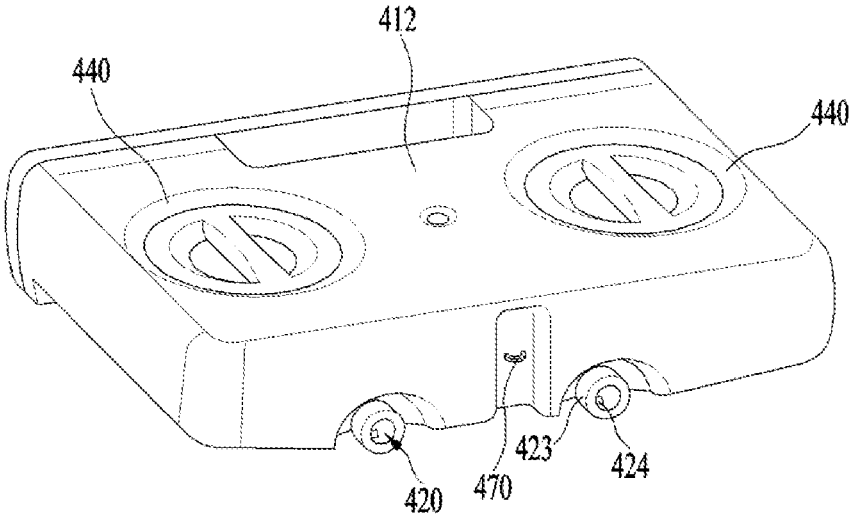

Referring to FIG. 11, the body 410 may further include a connection part 423, which protrudes outwards from the through-hole 420. The connection part 423 may further include a projection 424, which protrudes inwards.

When the check valve 500 is coupled to the connection part 423, the head 510 may be coupled to the through-hole 420 while surrounding the outer circumferential surface of the connection part 423.

In this way, the check valve 500 may be removably coupled to the through-hole 420.

The insertion part 520 may further include a first guide line 522, which extends in the longitudinal direction of the insertion part 520, and a second guide line 523, which extends from one end of the first guide line 522 in the circumferential direction of the head 510, in order to guide the movement of the projection 424.

The first guide line 522 may serve to guide the projection 424 so as to move toward the head. The second guide line 523 may serve to guide the projection 424 so as to move in the circumferential direction of the head and to be secured to the insertion part 520.

Therefore, when the check valve 500 starts to be coupled to the through-hole 420, the projection 424 may move along the first guide line 522 of the insertion part 520. When the coupling of the check valve 500 to the through-hole 420 is completed, the projection 424 may move along the second guide line 523, and consequently the check valve 500 may be secured to the through-hole 420 so as not to be separated therefrom.

At this time, in order to couple or separate the check valve 500 to or from the through-hole 420, the check valve 500 must be rotated. Therefore, in order to facilitate the rotation of the check valve 500, the check valve 500 may further include a valve knob 511, which protrudes from the head 510.

As a result, owing to this removable coupling between the check valve 500 and the detergent box 400, a user may conveniently clean the interior of the detergent box 400 merely by separating the check valve 500 from the detergent box 400.

Figure 16:
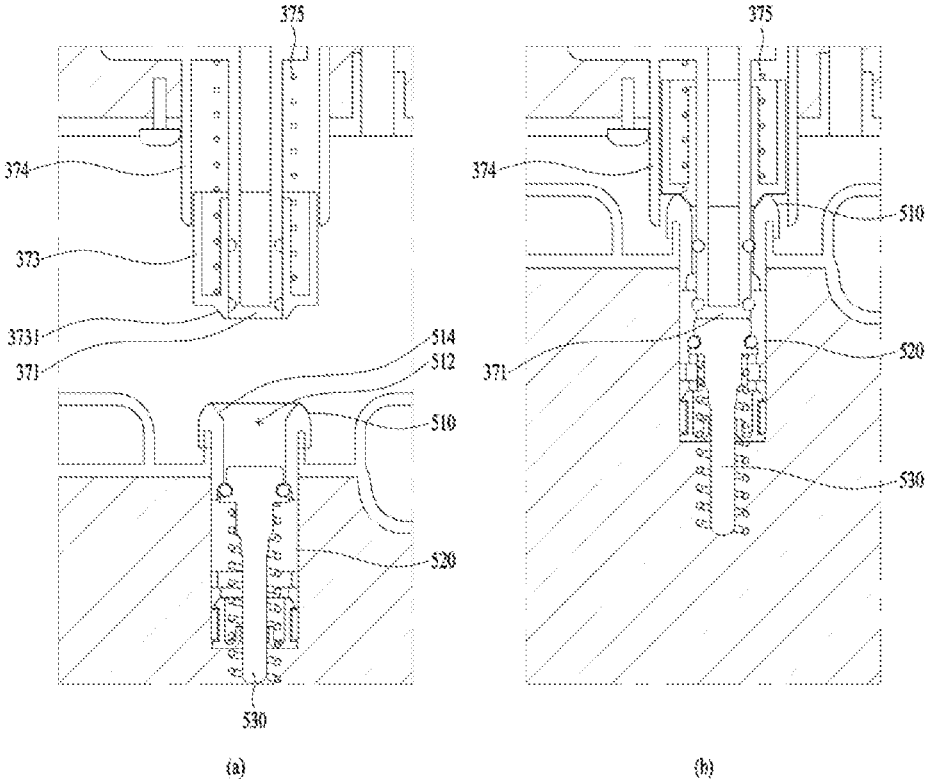
FIG. 16 is a view illustrating the coupling process between the check valve and the detergent pump.

The process of coupling the check valve 500 and the detergent pump 310 will now be described with reference to FIG. 16.

Referring to FIG. 16A, the check valve 500 is in a state of being inserted in the detergent box 400, and the connection part 370 is in a state of protruding from the detergent box accommodation part 210.

Referring to FIG. 16B, the detergent box 400 is inserted into the detergent box accommodation part 210, and the inflow column 371 is inserted into the outflow hole 512 in the head 510 of the check valve 500. That is, the inflow column 371 inserted into the outflow hole 512 pressurizes the valve piston 530.

Accordingly, the inflow column 371 is inserted into the detergent box 400, and the inflow hole 372 in the inflow column 371 and the outflow hole 512 in the insertion part communicate with each other.

Further, in the above-described process, the head 510 of the check valve 500 is inserted into the protecting part 374 and pressurizes the inflow hole opening/closing part 373.

At this time, the head 510 and the inflow hole opening/closing part 373 have surface contact therebetween, thereby preventing leakage of the liquid detergent or the fabric softener.

As such, since the liquid detergent or the fabric softener is introduced into the detergent pump 310 in the state in which the inflow column 371 is inserted in the detergent box 400, it is possible to prevent the detergent from leaking outside the connection part 370.

Since the sealing ring is in contact with the inner circumferential surface of the head 510 and the upper portion of the head 510 and the distal end of the inflow hole opening/closing part 373 have surface contact therebetween, it is possible to secondarily prevent the liquid detergent or the fabric softener from leaking outside the connection part 370.

The head 510 may have a stepped part 514 formed on the inner circumferential surface of the outflow hole 512, and the inflow hole opening/closing part 373 have a contact part 3732 formed corresponding to the stepped part 514 so as to come into close contact with the stepped part 514. Accordingly, the detergent leakage may be more securely prevented.

Further, the stepped part may have an inclination, and the contact part may also have an inclination corresponding to the stepped part. This may further facilitate the surface contact between the head 510 and the inflow hole opening/closing part 373, thereby effectively preventing the detergent leakage.

The stepped part 514 may increase the cross-sectional area of the outflow hole 512 toward the upper end of the head 510 in a stepped or slanted manner.

The sealing structure of the injection hole 430 will now be described with reference to FIGS. 17 and 18.

Figure 17:
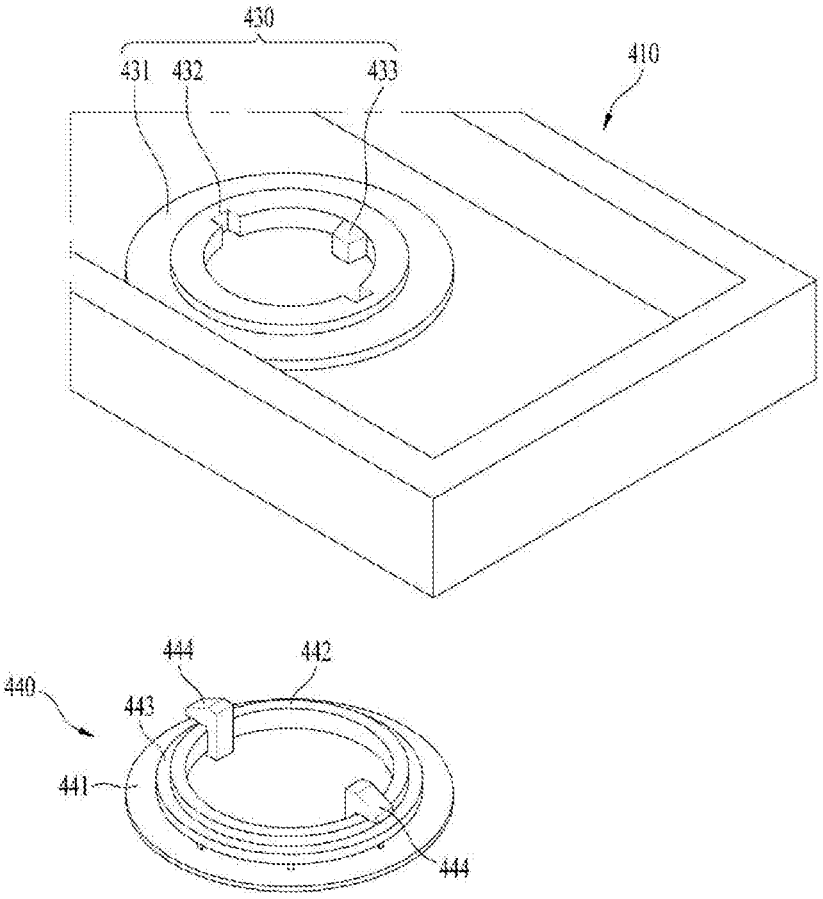
FIG. 17 is a view illustrating an injection hole and a cap of the detergent box.
Figure 18:
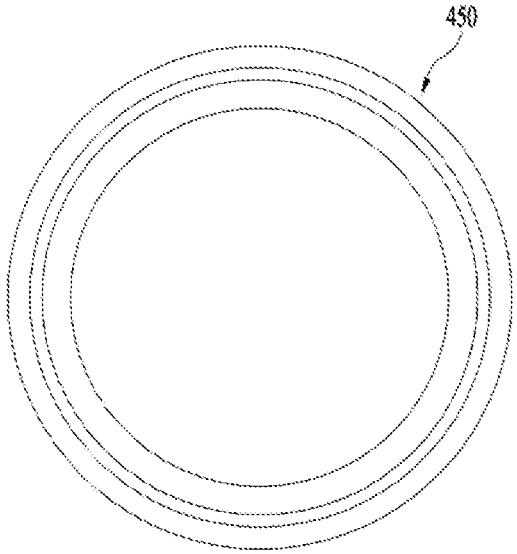
FIG. 18 is a view illustrating a sealing member provided at the cap.
Figure 18:
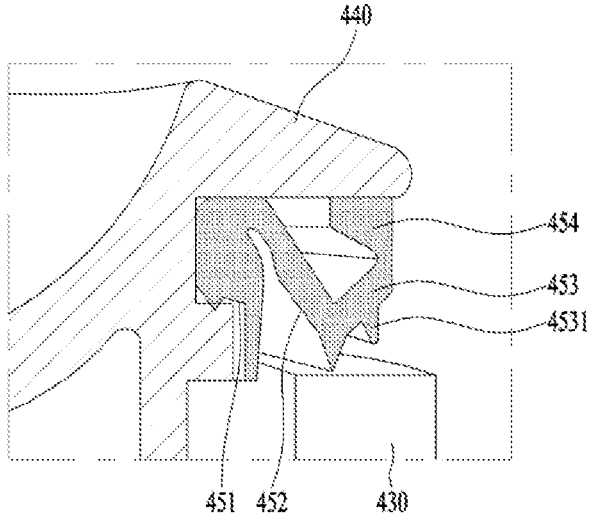

FIG. 17 is a view illustrating the injection hole 430 when seen from the interior of the detergent box 400, and FIG. 18 is a view illustrating the cap 440 for opening and closing the injection hole 430.

The injection hole 430 may be formed through the upper surface 412 of the body 410 and may have a circular shape.

The injection hole 430 may include a cap support part 431, which is concavely formed in the body 410 to support the cap 440, an incision part 432, which is formed by incising a portion of the cap support part 431, and a detergent-level-indicating part 433, which protrudes from the cap support part 431.

The detergent-level-indicating part 433, which protrudes from the cap support part 431, may extend parallel to the upper surface 412 of the body 410.

When the detergent box 400 is filled with the liquid detergent or the fabric softener, the liquid detergent or the fabric softener reaches the detergent-level-indicating part 433. This enables a user to stop injection of the liquid detergent or the fabric softener.

That is, the detergent-level-indicating part 433 may serve to indicate the allowable maximum amount of liquid detergent or fabric softener that can be injected into the detergent box 400 to a user.

As a result, it is possible to prevent excessive injection of the liquid detergent or the fabric softener into the detergent box 400 and resultant overflow thereof.

The incision part 432 may serve to facilitate the coupling of the cap 440 to the injection hole 430.

FIG. 17 illustrates a perspective view showing the bottom surface of the cap 440.

The cap 440 may include a cap body 441, which is seated in the injection hole 430 and the cap support part 431, a cap insertion body 442, which extends vertically from the cap body 441 and is inserted into the inner circumferential surface of the cap support part 431, a sealing rib 443, which protrudes from the cap insertion body 442 toward the outer circumferential surface of the cap body 441, and a fastening part 444, which protrudes from the distal end of the cap insertion body 442 toward the outer circumferential surface of the cap body.

Accordingly, when the cap 440 is seated in the injection hole 430, the fastening part 444 is inserted into the incision part 432, and the cap insertion body 442 is inserted into the detergent box 400.

At this time, the cap body 441 may be seated on the cap support part 431 and may shut the injection hole 430. Subsequently, the cap 440 may be rotated so that the fastening part 444 moves to a region below the cap support part 431, whereby the cap 440 may be secured to the injection hole 430.

Figure 19:
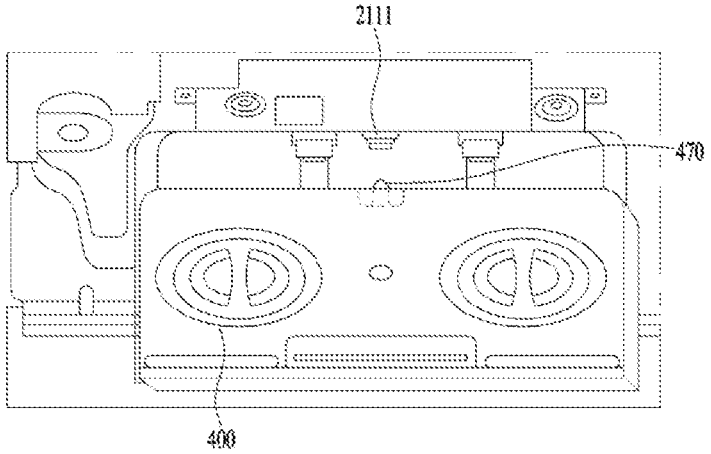
FIG. 19 is a view illustrating the structure and the operational principle of a push button provided at the detergent box.
Figure 19:
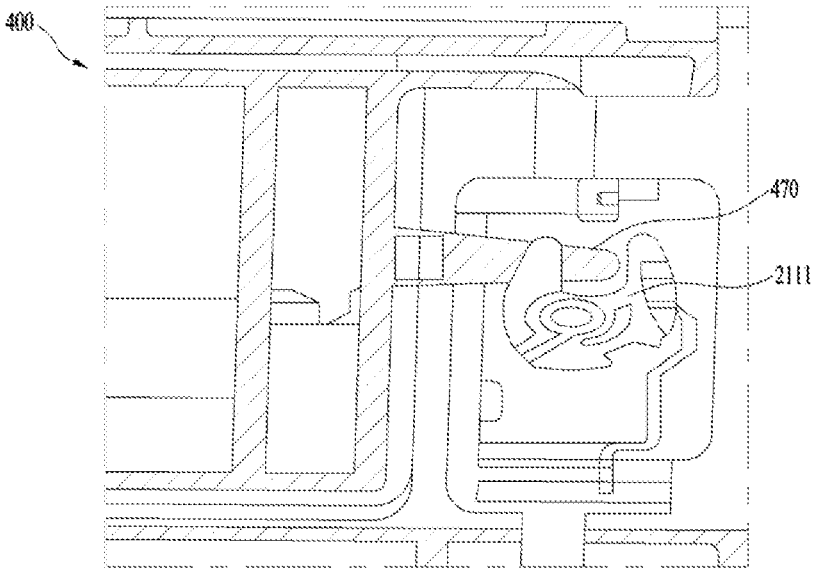

A sealing member for sealing a space between the cap 440 and the injection hole 430 will now be described with reference to FIGS. 18 and 19.

Although the cap 440 shuts the injection hole 430, a space may be present between the cap 440 and the injection hole 430, through which the liquid detergent or the fabric softener in the detergent box 400 may leak when the laundry treatment apparatus vibrates.

Therefore, in order to prevent this problem, the laundry treatment apparatus according to the embodiment of the present invention may further include a sealing member 450.

FIG. 18A is a view illustrating the sealing member when seen from the front, and FIG. 18B illustrates a sectional view in the state in which the sealing member is coupled to the cap 440.

The sealing member 450 may be made of an elastic material and may have an annular shape. The sealing member 450 may be disposed between the cap 440 and the injection hole 430.

Specifically, the sealing member 450 may be secured to the cap 440 in a manner such that the sealing member 450 is fitted into a space between the cap insertion body 442 and the sealing rib 443.

Therefore, when the cap 440 is seated in and coupled to the injection hole 430, the sealing member 450 may be compressed and may fill in the space between the cap 440 and the injection hole 430, thereby exhibiting a sealing effect.

However, if the sealing member 450 is excessively compressed, repulsive force may be generated, causing the cap 440 to be separated from the injection hole 430.

Therefore, in order to prevent this problem, the sealing member 450 according to the embodiment of the present invention may have the following unique structure.

The sealing member 450 may include a first sealing part 451, which is in contact with the sealing rib 443 and the cap insertion body 442, a second sealing part 452, which extends from the distal end of the first sealing part 451 in a slanted manner in the inward direction of the first sealing part 451, and a third sealing part 453, which extends from the distal end of the second sealing part 452 in a slanted manner at a predetermined angle with respect to the second sealing part 452 in a direction opposite the extending direction of the second sealing part 452.

That is, the sealing member 450 may be formed such that the first to third sealing parts 451, 452 and 453 extend in a zigzag pattern.

Therefore, it can be said that the sealing member 450 further includes a first bent part formed between the first sealing part 451 and the second sealing part 452 and a second bent part formed between the second sealing part 452 and the third sealing part 453.

It can also be said that the second sealing part 452 extends from the distal end of the first sealing part 451 at an acute angle and the third sealing part 453 extends from the distal end of the second sealing part 452 at an acute angle.

It can also be said that the sealing member 450 includes a first groove and a second groove that are open in opposite directions.

As a result of the sealing member 450 having the above-described structure, even when the cap 440 and the injection hole 430 are pressurized, a large repulsive force may not be generated. In addition, the contact area between the sealing member 450 and the cap support part 431 may be increased, thus perfectly sealing the space between the cap 440 and the injection hole 430.

The sealing member 450 may further include a contact part 454, which extends from the third sealing part 453 so as to be in surface contact with the cap body 441 or the cap support part 431.

The contact part 454 may extend from the third sealing part 453 toward the cap body 441.

Therefore, when the sealing member 450 is compressed, repulsive force may be minimized and elastic force and a distance between the third sealing part 453 and the contact part 454 may be maintained, thereby effectively sealing the space between the cap 440 and the injection hole 430.

Further, since a groove is formed at the region at which the second sealing part 452 extends from the first sealing part 451, repulsive force generated when the sealing member 450 is compressed may be minimized. That is, when the sealing member 450 is compressed, the first sealing part 451 and the second sealing part 452 may come into close contact with each other, thus minimizing the repulsive force.

The sealing member 450 may further include a projection 4531, which protrudes from the third sealing part 453.

Therefore, when the sealing member 450 is compressed, the bent part between the second sealing part 452 and the third sealing part 453 and the projection 4531 may be brought into contact with the cap body 441 or the cap support part 431, thus effectively sealing the space between the cap 440 and the injection hole 430.

Hereinafter, the structure of the push button will be described with reference to FIG. 19.

FIG. 19A illustrates the process of inserting the detergent box 400 into the detergent box accommodation part 210, and FIG. 19B illustrates a sectional view showing the coupling state between a link and a coupling member 2211.

The detergent box 400 may include a link 470, which protrudes from the rear surface 414 of the body 410, and the detergent box accommodation part 210 may include a coupling member 2211, which is positioned corresponding to the link 470.

The coupling member 2211 may have a "C" shape.

The coupling member 2211 may be formed to have a push button configuration.

Therefore, when the detergent box 400 is inserted into the detergent box accommodation part 210, the link 470 may be fastened to the coupling member 2211.

Thereafter, when a user pushes the detergent box 400 and consequently the link 470 pushes the coupling member 2211 backwards, the coupling member 2211 may release the fastening force and may be inclined forwards.

Therefore, it is possible to draw the detergent box 400 out of the detergent box accommodation part 210.

As a result, it is possible to prevent the liquid detergent or the fabric softener from leaking due to undesired separation of the detergent box 400 attributable to vibration of the laundry treatment apparatus.

As is apparent from the above description, a laundry treatment apparatus according to the embodiment of the present invention is capable of increasing a coupling force between a detergent box and a detergent pump.

In addition, it is possible to completely discharge detergent out of the detergent box.

In addition, since a check valve is provided at the detergent box in a removable manner, a user may easily clean the detergent box.

In addition, a sealing member of the detergent box may exhibit improved sealing performance and reduced repulsive force or elastic force.

It will be apparent to those skilled in the art that various modifications and variations can be made in the present invention without departing from the spirit or scope of the invention. Thus, it is intended that the present invention covers the modifications and variations of this invention provided they come within the scope of the appended claims and their equivalents.

Accordingly, the present invention is directed to a laundry treatment apparatus that substantially obviates one or more problems due to limitations and disadvantages of the related art.

An object of the present invention is to provide a laundry treatment apparatus capable of increasing a coupling force between a detergent box and a detergent pump.

Another object of the present invention is to provide a laundry treatment apparatus capable of completely discharging detergent out of the detergent box.

Another object of the present invention is to provide a laundry treatment apparatus, in which a check valve is provided at the detergent box in a removable manner, thereby enabling a user to easily clean the detergent box.

A further object of the present invention is to provide a laundry treatment apparatus, in which a sealing member of the detergent box exhibits improved sealing performance and reduced repulsive force or elastic force.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a laundry treatment apparatus includes a cabinet, a tub disposed in the cabinet to provide a washing space, a drum rotatably disposed in the tub to receive laundry placed therein, a detergent pump for supplying detergent to the tub, and a detergent box removably mounted to the detergent pump and configured to contain the detergent, wherein the detergent box includes a body for providing a space containing the detergent, and a through-hole formed in a rear side of the body to allow the detergent to flow out therethrough, and wherein the body includes a lower surface including a first slanted surface, the first slanted surface being slanted downwards from a front side of the body toward the rear side of the body, and the through-hole is located at the lowermost position of the body.

The through-hole may be spaced a predetermined distance apart from left and right surfaces of the body, and the lower surface of the body may further include a second slanted surface extending in a downwardly slanted manner from at least one of the left and right surfaces of the body toward the through-hole.

The detergent box may further include a check valve coupled to the through-hole to move the detergent in one direction, and a seating recess formed in the lower surface of the body to allow the check valve to be seated therein, and the first slanted surface and the second slanted surface may be slanted toward the seating recess.

The seating recess may be formed parallel to a ground.

The check valve may be removably coupled to the through-hole.

The body may include a connection part protruding backwards from an outer circumferential surface of the through-hole, and a projection protruding from an outer circumferential surface of the connection part. The check valve may include a head having an outflow hole through which the detergent flows out, an insertion part extending from one side of the head and inserted into the through-hole, a first guide line formed in an outer circumferential surface of the insertion part to guide the projection toward the head, and a second guide line extending from the first guide line to guide the projection in a circumferential direction of the head. The check valve may be removably secured to the through-hole.

The head may further include a knob for facilitating rotation of the insertion part so that the projection moves along the second guide line.

The check valve may further include a valve piston accommodated in the insertion part to open and close the outflow hole, a support part provided at one end of the insertion part, a valve spring provided around an outer circumferential surface of the valve piston so as to be in contact at one end thereof with the support part and to be in contact at an opposite end thereof with the valve piston, the valve spring selectively opening and closing the outflow hole by moving the valve piston inside the insertion part in a reciprocating manner, and an inflow hole formed through an outer circumferential surface of the insertion part and spaced apart from the first guide line at a predetermined angle.

The projection may be formed in upward and downward directions of the connection part, and the inflow hole may be spaced apart from the first guide line at an angle of 90 degrees.

The laundry treatment apparatus may further include a detergent box accommodation part configured to receive the detergent box therein. The detergent pump may be coupled to a rear surface of the detergent box accommodation part.

The detergent pump may be a piston pump including a pump body coupled to the rear surface of the detergent box accommodation part to form a flow passage and a pressurization space through which the detergent moves, a cylinder provided at one side of the pump body to communicate with the pressurization space, a piston for generating pressure variation in the pressurization space through reciprocating movement thereof inside the cylinder, and a driving unit for moving the piston in a reciprocating manner.

The pump body may further include an inflow column communicating with the pressurization space and protruding in a forward direction of the pump body, an inflow hole formed through one side of the inflow column and allowing the pressurization space to communicate with an outside, an inflow hole opening/closing part configured to slide along an outer circumferential surface of the inflow column so as to open and close the inflow hole, a protecting part formed around an outer circumferential surface of the inflow hole opening/closing part so as to accommodate the inflow hole opening/closing part, and an opening/closing spring provided around the outer circumferential surface of the inflow column so as to be in contact at one end thereof with the pump body and to be in contact at an opposite end thereof with the inflow hole opening/closing part, the opening/closing spring allowing the inflow hole opening/closing part to slide over the inflow hole.

When the detergent box is inserted into the detergent box accommodation part, the inflow column may be inserted into the outflow hole in the check valve and may come into contact with an inner circumferential surface of the insertion part, and the head of the check valve may push the inflow hole opening/closing part toward the pump body.

The head may have a stepped part formed on an inner circumferential surface of the outflow hole in a stepped manner, and the inflow hole opening/closing part may further include a contact part configured to be inserted into the stepped part.

The stepped part may be slanted toward a center of the inflow hole, and the contact part may be slanted corresponding to the shape of the stepped part.

The body of the detergent box may have at least one guide rib protruding from the lower surface thereof to guide insertion of the detergent box into the detergent box accommodation part, and the detergent box accommodation part may have a guide groove extending from a front side thereof to a rear side thereof to guide the guide rib.

The at least one guide rib may include a first guide rib disposed at a front side of the lower surface of the body and a second guide rib disposed at a rear side of the lower surface of the body, and the first guide rib and the second guide rib may protrude different lengths from the lower surface of the body in order to compensate for inclination of the first slanted surface so that the body is maintained parallel to a horizontal plane.

The first guide rib and the second guide rib may be positioned in alignment with each other so as to be commonly guided by the guide groove.

The detergent box may further include a knob formed through a front side of the body.

The laundry treatment apparatus may further include a link protruding from a rear surface of the detergent box and a coupling member provided at a region of the rear surface of the detergent box accommodation part that corresponds to a position of the link. When the detergent box is inserted into the detergent box accommodation part, the link and the coupling member may be fastened to each other.

The coupling member may be a push button.

The laundry treatment apparatus may further include an injection hole formed through an upper surface of the body to allow the detergent to be injected therethrough, a cap for opening and closing the injection hole, and a sealing member for sealing a space between the cap and the injection hole.

The sealing member may include a first sealing part coupled to an outer circumferential surface of the cap, a second sealing part extending from one end of the first sealing part in a slanted manner in an inward direction of the first sealing part, and a third sealing part extending from one end of the second sealing part in a slanted manner at a predetermined angle with respect to the second sealing part in a direction opposite an extending direction of the second sealing part.

The sealing member may further include a contact part extending from one end of the third sealing part toward a connection region between the first sealing part and the second sealing part.

The sealing member may further include a projection protruding outwards from one surface of the third sealing part.

The body may further include a partition wall extending from a front side of the body to a rear side of the body in order to divide the space in the body into a first space for containing first detergent and a second space for containing second detergent. The through-hole may include a first through-hole disposed at a region of the rear side of the body that defines the first space and a second through-hole disposed at a region of the rear side of the body that defines the second space. The injection hole may include a first injection hole disposed at a region of the upper surface of the body that defines the first space and a second injection hole disposed at a region of the upper surface of the body that defines the second space.

The lower surface of the body may include a third slanted surface extending from the partition wall toward the first through-hole in a downwardly slanted manner and a fourth slanted surface extending from the partition wall toward the second through-hole in a downwardly slanted manner.

The partition wall may be positioned closer to one of left and right surfaces of the body so that the first space is greater than the second space.

It is to be understood that both the foregoing general description and the following detailed description of the present invention are exemplary and explanatory and are intended to provide further explanation of the invention as claimed.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A laundry treatment apparatus comprising:

a cabinet;

a tub disposed in the cabinet to provide a washing space;

a drum rotatably disposed in the tub to receive laundry placed therein;

a detergent box that comprises a body to provide space for containing detergent and an accommodation part provided to withdrawably accommodate the body; and a detergent supply flow passage provided to connect on the accommodation part for supplying the detergent accommodated in the body to the tub, wherein the body comprises an upper surface, a lower surface, a left surface, a right surface, a front surface and a rear surface, wherein a through-hole is provided at a lower end of the rear surface and is configured to allow discharge of detergent, wherein a check valve is detachably connected to the through-hole, a first slanted surface that is slanted downwards from the front surface toward the rear surface, a seating recess that extends from a rear end of the first slanted surface to a rear end of the lower surface of the body, a second slanted surface that is extending in a downwardly slanted manner from at least one of the left surface or the right surface of the body toward the through-hole.

2. The laundry treatment apparatus according to claim 1, wherein the through-hole is formed at an area where the rear end of the lower surface meets the rear surface.

3. The laundry treatment apparatus according to claim 1, wherein the through-hole is spaced a predetermined distance apart from the left and right surfaces of the body.

4. The laundry treatment apparatus according to claim 3, wherein the seating recess is formed parallel to a bottom of the cabinet.

5. The laundry treatment apparatus according to claim 1, further comprising:

the accommodation part configured to receive the detergent box;

a detergent pump to connect to the detergent box and is configured to pump the detergent from the detergent box and to supply the detergent to the tub, wherein the detergent pump is coupled to a rear surface of the accommodation part.

6. The laundry treatment apparatus according to claim 5, wherein the body of the detergent box has at least one guide rib protruding from the lower surface of the body to guide insertion of the detergent box into the accommodation part, and the accommodation part has a guide groove extending from a front side of the accommodation part to a rear side of the accommodation part to guide the guide rib.

7. The laundry treatment apparatus according to claim 6, wherein the at least one guide rib includes a first guide rib disposed at a front side of the lower surface of the body, and a second guide rib disposed at a rear side of the lower surface of the body, and wherein the first guide rib and the second guide rib protrude different lengths from the lower surface of the body in order to compensate for inclination of the first slanted surface so that the body is maintained parallel to a horizontal plane.

8. The laundry treatment apparatus according to claim 7, wherein the first guide rib and the second guide rib are positioned in alignment with each other so as to be commonly guided by the guide groove.

9. The laundry treatment apparatus according to claim 8, further comprising:

a link protruding from a rear surface of the detergent box; and a coupling member provided at an area of the rear surface of the accommodation part that corresponds to a position of the link, wherein, when the detergent box is inserted into the accommodation part, the link and the coupling member are fastened to each other.

10. The laundry treatment apparatus according to claim 1, further comprising:

an injection hole formed in the body and through which the detergent is to be injected into the body;

wherein the body includes a partition wall extending from a front side of the body to a rear side of the body in order to divide the space in the body into a first space for containing first detergent and a second space for containing second detergent, the through-hole includes a first through-hole disposed at an area of the rear side of the body that defines the first space and a second through-hole disposed at an area of the rear side of the body that defines the second space, and the injection hole includes a first injection hole disposed at an area of the upper surface of the body that defines the first space and a second injection hole disposed at an area of the upper surface of the body that defines the second space.

11. The laundry treatment apparatus according to claim 10, wherein the lower surface of the body includes a third slanted surface that extends from the partition wall toward the first through-hole in a downwardly slanted manner and a fourth slanted surface that extends from the partition wall toward the second through-hole in a downwardly slanted manner.

12. The laundry treatment apparatus according to claim 10, wherein the partition wall is positioned closer to one of the left surface or the right surface of the body so that the first space is greater than the second space.

13. A laundry treatment apparatus comprising:

a cabinet;

a tub disposed in the cabinet to provide a washing space;

a drum rotatably disposed in the tub to receive laundry placed therein;

a detergent box that includes a body to provide space for containing detergent and an accommodation part provided to withdrawably accommodate the body; and a detergent supply flow passage configured to allow the detergent to be supplied from the detergent box to the tub, wherein the body comprises:

a first slanted surface that is slanted downwards from a front side of the body toward a rear side of the body; and a first guide rib extending from a bottom surface of the first slanted surface to be supported on a bottom surface of the accommodation part to compensate for inclination of the first slanted surface.

14. The laundry treatment apparatus according to claim 13, wherein the body comprises a through-hole formed at a rear side of the body to allow the detergent to flow out therethrough, wherein the through-hole is spaced at least a predetermined distance apart from left and right surfaces of the body, a lower surface of the body includes a second slanted surface that is slanted downwards from at least one of the left surface or the right surface of the body to the through-hole.

15. The laundry treatment apparatus according to claim 14, wherein the detergent box comprises a check valve that is to be removably fitted into the through-hole and a seating recess defined at the lower surface of the body and in which the check valve is seated, wherein the second slanted surface extends in a downwardly slanted manner from at least one of the left surface and the right surface of the body toward the seating recess.

16. The laundry treatment apparatus according to claim 14, wherein the body comprises a first guide rib disposed at a front side of the lower surface of the body, and a second guide rib disposed at a rear side of the lower surface of the body, wherein the first slanted surface and the second slanted surface protrude different lengths from the lower surface of the body in order to compensate for inclination of the first slanted surface so that the body is maintained parallel to a horizontal plane.

17. The laundry treatment apparatus according to claim 16, comprising the accommodation part configured to receive the detergent box, wherein the accommodation part includes a guide groove extended from a front side of the accommodation part to a rear side of the accommodation part so as to guide a direction in which the detergent box is inserted into or drawn out of the accommodation part.

18. The laundry treatment apparatus according to claim 17, wherein the first guide rib and the second guide rib are positioned in alignment with each other so as to be commonly guided by the guide groove.

19. The laundry treatment apparatus according to claim 14, wherein the body includes a partition wall extending from the front side of the body to the rear side of the body in order to divide the space in the body into a first space for containing first detergent and a second space for containing second detergent, the through-hole includes a first through-hole disposed at an area of the rear side of the body that defines the first space and a second through-hole disposed at a region of the rear side of the body that defines the second space, and the injection hole includes a first injection hole disposed at an area of an upper surface of the body that defines the first space and a second injection hole disposed at an area of the upper surface of the body that defines the second space.

20. The laundry treatment apparatus according to claim 19, wherein the lower surface of the body includes a third slanted surface that extends from the partition wall toward the first through-hole in a downwardly slanted manner and a fourth slanted surface that extends from the partition wall toward the second through-hole in a downwardly slanted manner.

* * * * *